US011686227B2

(12) United States Patent
Schiefer et al.

(10) Patent No.: US 11,686,227 B2
(45) Date of Patent: Jun. 27, 2023

(54) PORTABLE PUMP AND FUEL CONTAINMENT SYSTEM

(71) Applicant: S. BRAVO SYSTEMS, INC., Commerce, CA (US)

(72) Inventors: Thomas Patrick Schiefer, Phoenix, AZ (US); Don Mukai, Commerce, CA (US); Max Cohen, Commerce, CA (US); Adam Macias, Commerce, CA (US); Eric Emerson, Commerce, CA (US); Ricardo Burgos, Commerce, CA (US); Mamdouh Elsharkawy, Commerce, CA (US)

(73) Assignee: S. Bravo Systems, Inc., Commerce, CA (US)

( * ) Notice: Subject to any disclaimer, the term of this patent is extended or adjusted under 35 U.S.C. 154(b) by 228 days.

(21) Appl. No.: 17/060,535

(22) Filed: Oct. 1, 2020

(65) Prior Publication Data

US 2021/0095585 A1 Apr. 1, 2021

Related U.S. Application Data

(60) Provisional application No. 62/909,163, filed on Oct. 1, 2019.

(51) Int. Cl.

| | |
|---|---|
| ***F01M 11/04*** | (2006.01) |
| ***F02M 37/44*** | (2019.01) |
| ***F02M 37/10*** | (2006.01) |

(52) U.S. Cl.

CPC ..... *F01M 11/04* (2013.01); *F02M 37/106* (2013.01); *F02M 37/44* (2019.01)

(58) Field of Classification Search

None

See application file for complete search history.

(56) References Cited

U.S. PATENT DOCUMENTS

| | | | | |
|---|---|---|---|---|
| 5,597,601 | A * | 1/1997 | Griffin | A47J 37/1223 210/DIG. 8 |
| 6,207,051 | B1 * | 3/2001 | Anderson | B01D 46/2411 210/241 |
| 7,033,513 | B2 * | 4/2006 | Riggins | B01D 36/003 210/167.04 |
| D577,415 | S * | 9/2008 | Reid | D23/209 |
| 7,993,530 | B2 * | 8/2011 | Horne | B01D 35/26 210/171 |

(Continued)

*Primary Examiner* — Robert J Popovics

(74) *Attorney, Agent, or Firm* — Lewis Roca Rothgerber Christie LLP

(57) ABSTRACT

A portable pump and fuel containment system includes a portable base assembly including a lower support and wheels, a container on the lower support including an interior volume and inlet and outlet ports in fluid communication with the interior volume, and a liquid transfer assembly coupled to the portable base assembly. The liquid transfer assembly includes a pump, a three-way control valve, a flexible transfer line having a first transfer line segment coupled to a first inlet of the three-way control valve and a second transfer line segment extending from the outlet port to a second inlet of the three-way control valve, and a flexible return line having a first end coupled to the outlet of the pump and a second end detachably coupled to the inlet port of the container. An outlet of the three-way control valve is connected to an inlet of the pump.

20 Claims, 20 Drawing Sheets

(56) References Cited

U.S. PATENT DOCUMENTS

| | | | | |
|---|---|---|---|---|
| 8,147,683 | B2 * | 4/2012 | Wilson | B01D 35/143 210/90 |
| 8,153,001 | B2 * | 4/2012 | Peters | B01D 29/27 210/406 |
| 8,268,179 | B2 * | 9/2012 | Peters | B01D 29/27 210/406 |
| 8,926,847 | B1 * | 1/2015 | Schade | B01D 21/2405 210/167.01 |
| 8,992,773 | B2 * | 3/2015 | Marheine | B01D 35/26 210/167.28 |
| 11,396,833 | B2 * | 7/2022 | Scudder | F01M 11/0004 |
| 2007/0075005 | A1 * | 4/2007 | Haworth | B01D 35/26 210/416.1 |
| 2007/0266679 | A1 * | 11/2007 | Horne | B01D 35/26 55/356 |
| 2011/0180492 | A1 * | 7/2011 | Wilson | B01D 35/1475 210/136 |
| 2012/0193304 | A1 * | 8/2012 | Peters | B01D 29/27 210/767 |
| 2013/0233403 | A1 * | 9/2013 | Bedi | H01J 9/38 137/15.01 |
| 2020/0105491 | A1 * | 4/2020 | Bedi | F01P 11/0276 |
| 2020/0240298 | A1 * | 7/2020 | Scudder | F16N 31/00 |
| 2021/0095585 | A1 * | 4/2021 | Schiefer | F02M 37/44 |

* cited by examiner 800
808
801
807
806
818
802
819
809
804

800
804
813
808
812
801
819
811
807
810
809
806
802
803

806
807
818
801
811
813
812
809
810
804
805

PORTABLE PUMP AND FUEL CONTAINMENT SYSTEM

CROSS-REFERENCE TO RELATED APPLICATION

The present application claims priority to and the benefit of U.S. Provisional Application No. 62/909,163, filed Oct. 1, 2019, the entire contents of which are incorporated herein by reference.

BACKGROUND

1. Field

The present disclosure relates generally to a portable pump and fuel containment system configured to pump and contain fuel or fuel-contaminated fluid from a secondary containment system, such as a sump.

2. Description of Related Art

Facilities that store large quantities of fuel or petroleum generally have a plan for containing a spill. For example, facilities may employ secondary containment systems to limit the scope of contamination and provide cost-effective cleanup when a spill or leak occurs. In fact, some organizations such as the United States Environmental Protection Agency may require certain facilities to employ secondary containment systems. One example of a secondary containment system is a sump or catch-basin designed to collect undesirable fuel or fuel-contaminated fluids.

However, a range of sources may introduce solids and fluids into the sumps. For example, rainwater may introduce debris and water into the sumps or there may be a minor or temporary leak caused by system maintenance. Therefore, sumps may accumulate significant waste buildup over time. In order to maintain the sumps and comply with safety guidelines, facility operators generally purge at least fluids from the sumps.

For purging the sumps, many facility operators decide to use readily available shop vacuums. However, shop vacuums have a very high potential to explode when an exposed electrical motor ignites fuel vapors emanating from the sump. The resulting explosion can endanger the operator and the public by setting fire to the sump and/or the surrounding area.

A safer option involves the use of a vacuum truck. However, vacuum trucks require specialized equipment such as a compressor for pneumatics, air lines, and a vacuum or diaphragm pump. As a result, requesting a vacuum truck can be expensive and time-consuming. Often, vacuum trucks are not immediately available and a facility operator may wait an entire day or more. In some circumstances, waiting for a vacuum truck may leave a portion of the facility down for maintenance and result in the facility operator resorting to a dangerous shop vacuum. Further, due to the large size and cumbersome nature of a vacuum truck, it may be impractical to position the truck close to each sump. This results in vacuum trucks running lengthy air lines from the compressor to the vacuum at each sump. Exposed air lines present a hazard for pedestrians and/or cars which may become entangled with the air lines.

SUMMARY

The present disclosure relates to various embodiments of a portable pump and fuel containment system. In one embodiment, the system includes a portable base assembly including a lower support having an upper surface and a lower surface, and a series of wheels coupled to the lower surface of the lower support. The system also includes a container on the upper surface of the lower support. The container defines an interior volume, an inlet port in fluid communication with the interior volume, and an outlet port in fluid communication with the interior volume. The system also includes a liquid transfer assembly coupled to the portable base assembly. The liquid transfer assembly includes a pump having an inlet, an outlet, and a motor, and a three-way control valve including a first inlet, an outlet, a second inlet, a valve, and a lever coupled to the valve that is configured to move between a first position in which the valve places the first inlet in fluid communication with the outlet, and a second position in which the valve places the second inlet in fluid communication with the outlet. The liquid transfer assembly also includes a flexible transfer line having a first transfer line segment coupled to the first inlet of the three-way control valve, and a second transfer line segment extending from the outlet port of the container to the second inlet of the three-way control valve. The liquid transfer assembly also includes a flexible return line having a first end coupled to the outlet of the pump and a second end detachably coupled to the inlet port of the container. The outlet of the three-way control valve is connected to the inlet of the pump. When the pump is activated and the lever is in the first position, the portable pump and fuel containment system is configured to pump fluid through the first transfer line segment and the flexible return line and into the interior volume of the container through the inlet port. When the pump is activated, the lever is in the second position, and the second end of the flexible return line is detached from the inlet port, the portable pump and fuel containment system is configured to pump the fluid in the interior volume of the container out through the second transfer line segment and the flexible return line. The pump may be a diaphragm pump or a centrifugal pump.

The system may also include a y-valve including a y-strainer coupled between the outlet of the three-way control valve and the inlet of the pump.

The system may also include a stinger including at least one filter coupled to an end of the first transfer line segment.

The stinger may include a body having a first end, a second end opposite the first end, and a passage extending from the first end to the second end. The second end may be configured to be detachably coupled to the first transfer line segment. The stinger may also include a filter cap including a one-way valve coupled to the first end of the body, and the at least one filter may include a primary filter, a secondary filter, and a tertiary filter of the filter cap.

The primary filter may have a first mesh size, the secondary filter may have a second mesh size less than the first mesh size, and the tertiary filer may have a third mesh size less than the second mesh size.

The system may also include a drop pipe coupled to an end of the second transfer line segment. The drop pipe extends downward through the interior volume and has a lower end proximate to a bottom of the container.

The lower end of the drop pipe may be spaced apart from the bottom of the container by a distance in a range from approximately 1 inch to approximately ¼ inch.

The system may also include a ball float valve in the interior volume of the container and coupled to the second end of the flexible return line.

The system may also include a check valve coupled to the second end of the flexible return line and between the ball float valve and the second end of the flexible return line. The check valve is configured to permit the fluid to flow from the flexible return line and into the interior volume of the container and prevent the fluid from flowing out of the interior volume of the container and into the flexible return line.

The system may also include a grounding strap coupled to the lower support of the portable base assembly.

The container of the system may also include a vertical vent pipe configured to vent vapor from the interior volume of the container.

The system may also include a camlock configured to detachably connect the second end of the flexible return line to the inlet port of the container.

The system may include a battery assembly on the lower support of the portable base assembly. The battery assembly may include an explosion proof box, at least one rechargeable battery housed in the explosion proof box, a first corrosion resistant fitting coupled to a charging port of the at least one rechargeable battery, a second corrosion resistant fitting coupled to a power port of the at least one rechargeable battery, and an electrical cable connecting the motor of the pump to the second corrosion resistant fitting. The electrical cable forms a waterproof seal with the second corrosion resistant fitting.

The portable base assembly may include an upper support and a partition connecting the upper support to the lower support. The upper support, the lower support, and the partition together define an isolation zone. The battery assembly may be in the isolation zone and the container may be outside of the isolation zone.

The present disclosure also relates to various embodiments of a system including the portable pump and fuel containment system, and a mount configured to facilitate transportation of the portable pump and fuel containment system.

The lower support of the portable base assembly may include a pair of crane rollers.

The mount may include a base plate, a front wall extending upward from the base plate, a sidewall extending upward from the base plate, and a channel section including an upper rail and a lower rail below the upper rail coupled to an interior surface of the sidewall. The crane rollers are configured to engage the channel segment when the portable pump and fuel containment system is supported on the mount.

The front wall of the mount may include a first opening. The lower support of the portable base assembly may include a base plate, a front lip segment extending along a front edge of the base plate, and a second opening in the front lip segment. The second opening may be configured to align with the first opening to accommodate a fastener or a lock for securing the portable pump and fuel containment system to the mount.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is related to various embodiments of the portable pump and fuel containment system. In one or more embodiments, the portable pump and fuel containment system includes a container configured to rest on a base assembly having wheels and a handlebar to enable an operator to move the system to the desired location. In one or more embodiments, the container may be filled and purged based on a pump and a three-way valve which determines whether the pump fills or purges the container. Therefore, the container does not have to be larger than desired to fit into tight spaces and may be easily stored on-site. In one or more embodiments, the portable pump and fuel containment system includes a drop pipe, a vent, a grounding device, a fire extinguisher, an explosion proof box housing a rechargeable battery, and/or a shielded isolation zone to protect an operator and the public.

Figure 1:
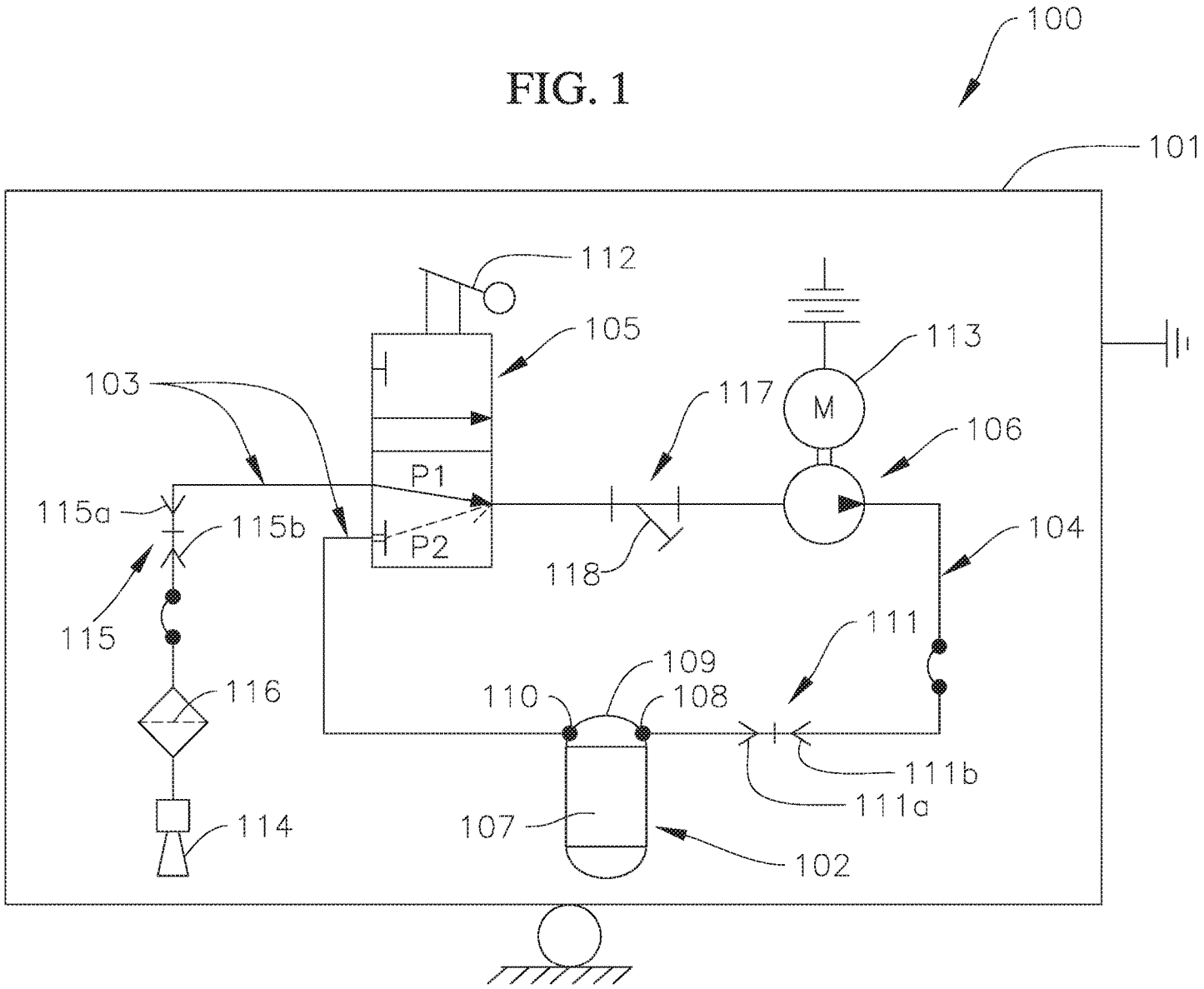
FIG. 1 is a schematic diagram of a portable pump and fuel containment system according to one embodiment of the present disclosure.

With reference now to FIG. 1, a portable pump and fuel containment system 100 according to one embodiment of the present disclosure includes a portable platform (e.g., a platform on wheels, such as casters) 101, a container (e.g., a drum) 102 supported by the portable platform 101, a transfer line (e.g., a flexible transfer hose) 103 coupled to the container 102, a return line (e.g., a flexible return hose) 104 coupled to the container 102, a three-way control valve 105 coupled to the portable platform 101, and a pump 106 coupled to the portable platform 101. The pump 106 is configured to draw fluid (e.g., fuel contained in a containment sump) in through the transfer line 103 and the return line 104 and into an interior volume 107 of the container 102 through an inlet port 108 on an upper surface (e.g., a lid 109) of the container 102. In the illustrated embodiment, the pump 106 is also configured to withdraw the fluid (e.g., fuel) stored in the interior volume 107 of the container 102 out through an outlet port 110 in the upper surface (e.g., the lid 109) of the container 102 with the return line 104. The three-way control valve 105 is configured to move between a first position P1 (shown in solid lines) in which the transfer line 103 is in fluid communication with the return line 104 and the inlet port 108 of the container 102 such that the portable pump and fuel containment system 100 is configured to pump fluid into the interior volume 107 of the container 102 through the transfer line 103 and the return line 104, and a second position P2 (shown in dashed lines) in which the return line 104 is in fluid communication with the outlet port 110 of the container 102 such that the portable pump and fuel containment system 100 is configured to pump fluid out of the interior volume 107 of the container 102 through the return line 104 (e.g., the three-way control valve 105 is configured to selectively place the transfer line 103 in fluid communication with the return line 104 and the inlet port 108 of the container 102, or place the return line 104 in fluid communication with the outlet port 110 of the container 102).

Additionally, in the illustrated embodiment, the portable pump and fuel containment system 100 includes a coupling 111 (e.g., quick release connector, such as a male and female cam lock 111*a*, 111*b*, respectively) configured to enable connection and disconnection of the return line 104 to and from the inlet port 108 of the container 102. The return line 104 may be connected to the inlet port 108 of the container 102 via the coupling 111 to transfer liquid (e.g., fuel) into the interior volume 107 of the container 102 when the three-way control valve 105 is in the first position P1, and the return line 104 may be disconnected from the inlet port 108 of the container 102 by disconnecting the coupling 111 (e.g., disconnecting the female cam lock 111*b* from the male cam lock 111*a*) to withdraw the liquid (e.g., fuel) from the interior volume 107 of the container 102 when the three-way control valve 105 is in the second position P2.

In the illustrated embodiment, the three-way control valve 105 is a ball-valve configured to be actuated manually between the first and second positions P1, P2 by a hand lever 112. In one or more embodiments, the three-way control valve 105 may be any other suitable type or kind of valve, and the valve may be actuated between the first and second positions P1, P2 by any suitable type of electrical, mechanical, hydraulic, or pneumatic mechanism.

The pump 106 may be any suitable type or kind of pump, such as, for instance, a centrifugal pump or a diaphragm pump. In general, a diaphragm pump may have better pumping characteristics (e.g., increased volumetric flow rate), modularity, and corrosion resistance properties compared to a centrifugal pump. Additionally, in the illustrated embodiment, the pump 106 is driven by an electric motor 113. In one or more embodiments, the pump 106 may be driven by any other suitable electrical, mechanical, hydraulic, or pneumatic mechanism.

In the illustrated embodiment, the portable pump and fuel containment system 100 also includes a nozzle (e.g., a stinger) 114 coupled to an end of the transfer line 103. In the illustrated embodiment, the nozzle 114 is detachably coupled to the end of the transfer line 103 with a quick-release fitting 115 (e.g., male and female cam locks 115*a*, 115*b*, respectively). In one or more embodiments, the nozzle 114 includes at least one filter 116 configured to filter particulates out from the liquid that is pumped from the containment sump (e.g., a filter having a mesh size ranging from 80 mesh to 120 mesh, such as 100 mesh). In one or more embodiments, the at least one filter 116 may include two or more filters having filtration sizes progressing from a relatively finer mesh to a relatively coarser mesh in a direction along with the fluid flows through the nozzle 114.

In the illustrated embodiment, the portable pump and fuel containment system 100 also includes a y-valve 117 including a y-filter (or y-strainer) 118 connected between the three-way control valve 105 and the pump 106. Accordingly, in the illustrated embodiment, the y-valve 117 (and the y-filter 118) are positioned upstream of the pump 106 (i.e., y-valve 117, and the y-filter 118 contained therein, are positioned in front of the inlet of the pump 106). The y-filter 118 is configured to filter particulates out of the fluid flowing through the transfer line 103 and thereby reduce the amount of particulates reaching the pump 106, which might otherwise degrade the performance of the pump 106 (e.g., by clogging the pump 106), prematurely wear the pump 106, and/or damage the pump 106. In one or more embodiments, the y-filter 118 may have a mesh size in a range from 20 mesh to 60 mesh (e.g., 40 mesh). Additionally, in one or more embodiments, the y-filter 118 may have a mesh size in a range from 10 mesh to 40 mesh (e.g., 20 mesh). In one or more embodiments, the filters 116, 118 of the portable pump and fuel containment system 100 progress from the finest mesh to the coarsest mesh in a direction along which the fluid flows through the transfer line 103 and/or the return line 104 (i.e., the porosity of the filters 116, 118 may increase in a direction along which the fluid flows through the transfer line 103 and/or the return line 104).

In operation, liquid, such as fuel, may be pumped from a containment sump (e.g., an under dispenser containment (UDC) unit) and into the interior volume 107 of the container 102 by inserting the nozzle 114 into the liquid in the containment sump (e.g., the UDC unit), moving or ensuring that the three-way control valve 105 is in the first position P1, and actuating the pump 106. In this manner, the fluid in the containment sump flows through the nozzle 114 (and the at least one filter 116 contained therein), through the transfer line 103, through the y-valve 117 (and the y-filter 118 contained therein), through the pump 106, through the return line 104, and into the interior volume 107 of the container through the inlet port 108 of the container 102.

To withdraw the fluid stored in the interior volume 107 of the container 102, the end of the return line 104 may be detached from the inlet port 108 of the container 102 (e.g., by disconnecting the coupling 111, such as by disconnecting the male and female cam locks 111*a*, 111*b*, respectively, of the quick-release connector), inserting the end of the return line 104 into a disposal bin or other waste receptacle, moving or ensuring that the three-way control valve 105 is in the second position P2, and actuating the pump 106. In this manner, the fluid in the interior volume 107 of the container 102 flows out through the outlet port 110 of the container 102, through a portion of the transfer line 103 extending between the container 102 and the three way control valve 105, through the y-valve 117 (and the y-filter 118 contained therein), through the pump 106, out through the end of the return line 104 at which a portion of the coupling 111 is connected, and into the disposal bin into which the end of the return line 104 is inserted.

With reference now to FIGS. 2A-2F, a portable pump and fuel containment system 200 according to one embodiment includes a portable base assembly 300 (e.g., a portable platform) and a container 400 supported on the portable base assembly 300. In the illustrated embodiment, the container 400 includes a bottom wall 401, at least one side wall 402 connected to and extending upward from a periphery (e.g., an outer edge or circumference) 403 of the bottom wall 401, and a top or upper wall 404 (e.g., a lid) connected to an upper end 405 of the at least one side wall 402. Together, the bottom wall 401, the side wall 402, and the upper wall 404 define an interior chamber or interior volume 406 configured to store fuel or fuel-contaminated liquid (e.g., liquid pumped from a sump, such as an under dispenser containment (UDC) unit). Although in the illustrated embodiment, the container 400 is a cylindrical drum, in one or more embodiments, the container 400 may be a prismatic shape (e.g., a rectangular prism), or any other suitable shape (including a non-prismatic shape) for storing liquid. Additionally, although in the illustrated embodiment, the interior volume 406 may be approximately 30 gallons, in one or more embodiments, the container 400 may have any other suitable fluid capacity depending, for instance, on the fluid containment capacity of the sumps from which the portable pump and fuel containment system 200 is designed to remove fluid. In the illustrated embodiment, the container 400 also includes an inlet port 407 (e.g., an opening) and an outlet port 408 in the upper wall 404. As described in more detail below, the inlet port 407 is configured to facilitate the transfer of liquid (e.g., fuel or fuel-contaminated liquid) into the interior volume 406 of the container 400, and the outlet port 408 is configured to facilitate the extraction of the liquid out of the interior volume 406 of the container 400.

In the illustrated embodiment, the portable pump and fuel containment system 200 also includes a liquid-transfer assembly 500 configured to deliver liquid (e.g., fuel or fuel-contaminated liquid) into the interior volume 406 of the container 400 and to extract the liquid from the interior volume 406 of the container 400. In the illustrated embodiment, the liquid-transfer assembly 500 includes a pump 501, a flexible transfer line 502 (e.g., a hose), a flexible return line 503 (e.g., a hose), a Y-valve 504 having a y-filter 505, a three-way control valve 506, and a nozzle 507 (e.g., a stinger). In the illustrated embodiment, the portable pump and fuel containment system 200 also includes a battery assembly 700 configured to power the pump 501 of the liquid-transfer assembly 500.

Additionally, in the illustrated embodiment, the flexible transfer line 502 includes a first transfer line segment 508 and a second transfer line segment 509. In the illustrated embodiment, the three-way control valve 506 is coupled to the flexible transfer line 502 between the first and second transfer line segments 508, 509. A first end 510 of the first transfer line segment 508 is coupled to the nozzle 507 (e.g., the stinger) and a second end 511 of the first transfer line segment 508 opposite the first end 510 is coupled to the three-way control valve 506 (e.g., with one or more couplings or fittings, such as one or more elbow connectors). A first end 512 of the second transfer line segment 509 is coupled to the three-way control valve 506 and a second end 513 of the second transfer line segment 509 opposite the first end 512 is coupled to or extends through the outlet port 408 of the container 400. In one or more embodiments, the second end 513 of the second transfer line segment 509 may be coupled to the outlet port 408 of the container 400 with one or couplings or fittings (e.g., an elbow pipe fitting). Additionally, in the illustrated embodiment, the nozzle 507 (e.g., the stinger) is detachably coupled to the first end 510 of the first transfer line segment 508 of the flexible transfer line 502 by a detachable coupling 514 (e.g., a quick-release fitting having male and female cam locks 514*a*, 514*b* configured to connect and disconnect from each other). In one or more embodiments, the nozzle 507 may be fixedly coupled to the first end 510 of the first transfer line segment 508 of the flexible transfer line 502.

In the illustrated embodiment, the pump 501 includes an inlet 515, an outlet 516, and a motor 517 (e.g., an electric motor) which, when activated, is configured to drive liquid into the inlet 515 and out through the outlet 516. The pump 501 may be any suitable type or kind of pump, such as, for instance, a centrifugal pump or a diaphragm pump. In general, a diaphragm pump may have better pumping characteristics (e.g., increased volumetric flow rate), modularity, and corrosion resistance properties compared to a centrifugal pump. Additionally, although in the illustrated embodiment the pump 501 is driven by an electric motor 517, in one or more embodiments, the pump 501 may be driven by any other suitable electrical, mechanical, hydraulic, or pneumatic mechanism. In one or more embodiments, the pump 501 may be a fuel-rated pump configured to pump approximately 12 gallons per minute or more.

In the illustrated embodiment, the three-way control valve 506 includes a first inlet 518, a second inlet 519, an outlet 520, a valve 521, and a mechanical arm 522 (e.g., a hand lever) coupled to the valve 521. Operation of the hand lever 522 (e.g., rotation of the hand lever 522) is configured to move the valve 521 between a first position P1 (shown in solid lines) in which the first inlet 518 is in communication with the outlet 520, and a second position P2 (shown in dashed lines) in which the second inlet 519 is in communication with the outlet 520 (i.e., the hand lever 522 and the valve 521 are configured to selectively place the first inlet 518 or the second inlet 519 in fluid communication with the outlet 520).

In the illustrated embodiment, the second end 511 of the first transfer line segment 508 is coupled to the first inlet 518 of the three-way control valve 506, the first end 512 of the second transfer line segment 509 is coupled to the second inlet 519 of the three-way control valve 506. Additionally, in the illustrated embodiment, an inlet 523 of the Y-valve 504 is coupled to the outlet 520 of the three-way control valve 506, and an outlet 524 of the Y-valve 504 is coupled to the inlet 515 of the pump 501. The y-filter 505 of the y-valve 504 is between the inlet 523 and the outlet 524. Accordingly, in the illustrated embodiment, the Y-valve 504 (and the Y-filter 505 contained therein) is coupled between the three-way control valve 506 and the pump 501, and the y-valve 504 (and the y-filter 505) are positioned upstream of the pump 501 (i.e., y-valve 504, and the y-filter 505 contained therein, are positioned in front of the inlet 515 of the pump 501). The y-filter 505 is configured to filter particulates out of the fluid flowing through the flexible transfer line 502 and thereby reduce the amount of particulates reaching the pump 501, which might otherwise degrade the performance of the pump 501 (e.g., by clogging the pump 501), prematurely wear the pump 501, and/or damage the pump 501. In one or more embodiments, the y-filter 505 may have a mesh size in a range from 20 mesh to 60 mesh (e.g., 40 mesh), or a mesh size in a range from 10 mesh to 40 mesh (e.g., 20 mesh).

Figure 2A:
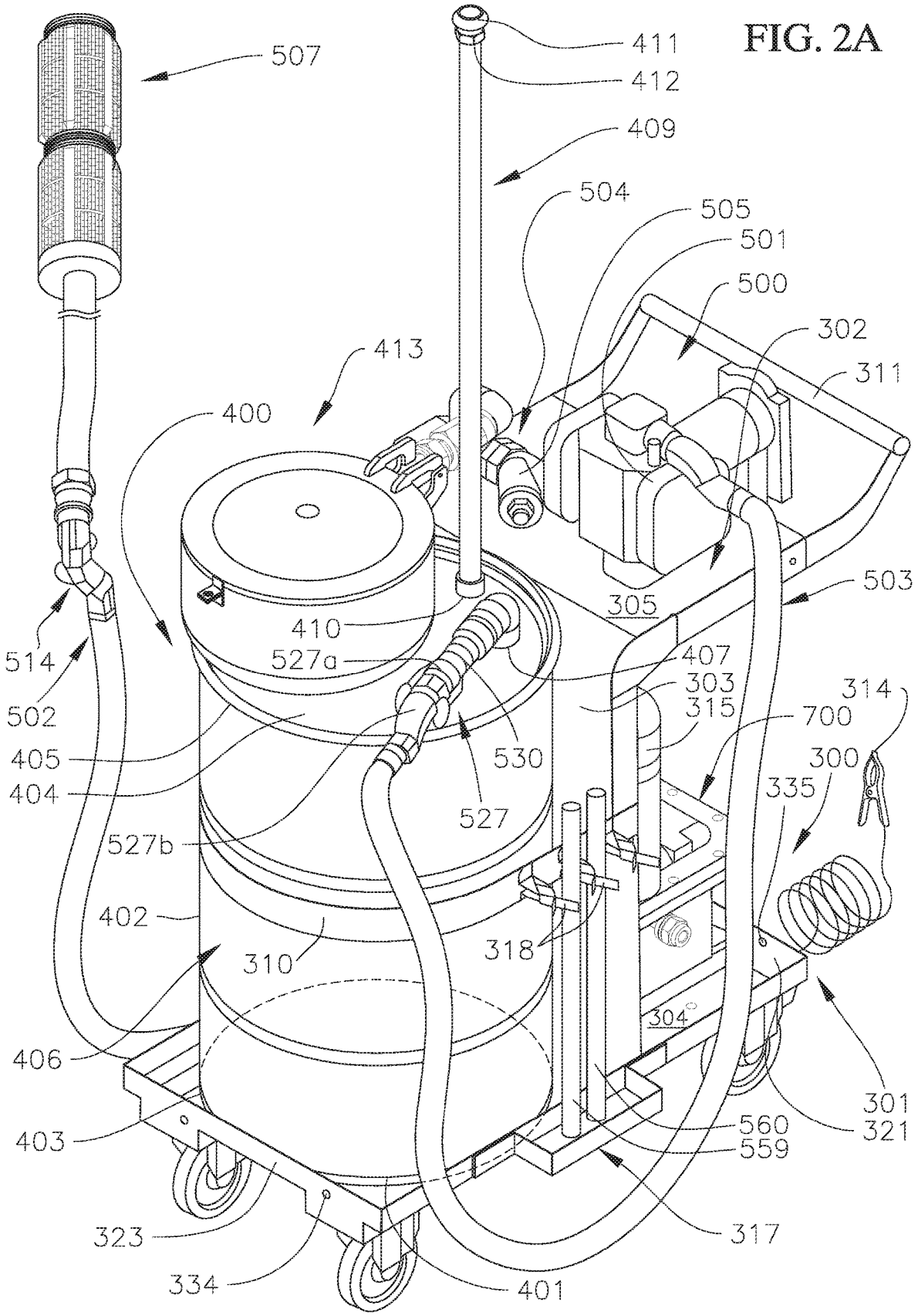
FIGS. 2A-2F are a front perspective view, a rear perspective view, a top view, a first cross-sectional view, a second cross-sectional view, and a rear view, respectively, of a portable pump and fuel containment system according to one embodiment of the present disclosure.
Figure 2B:
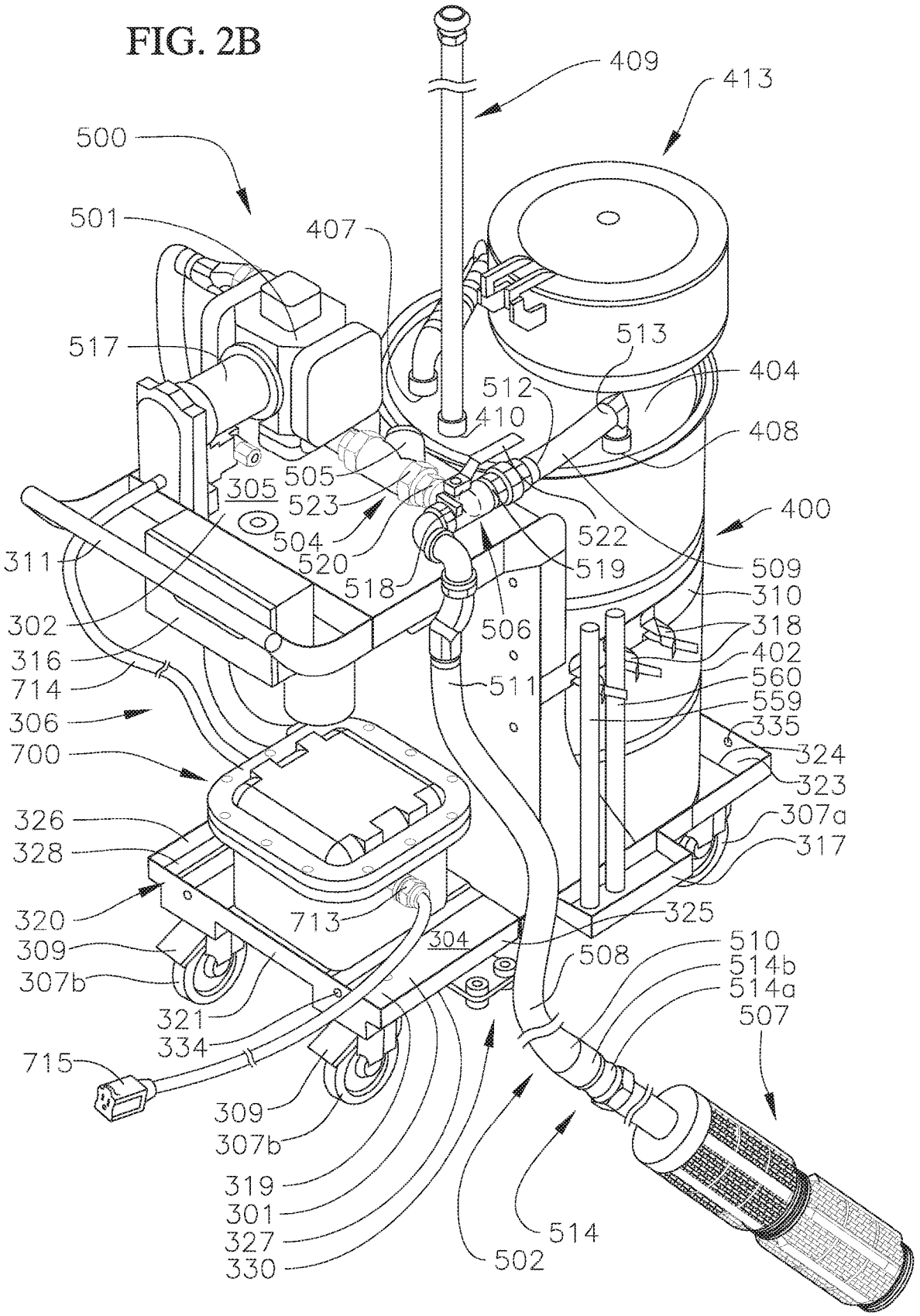
Figure 2C:
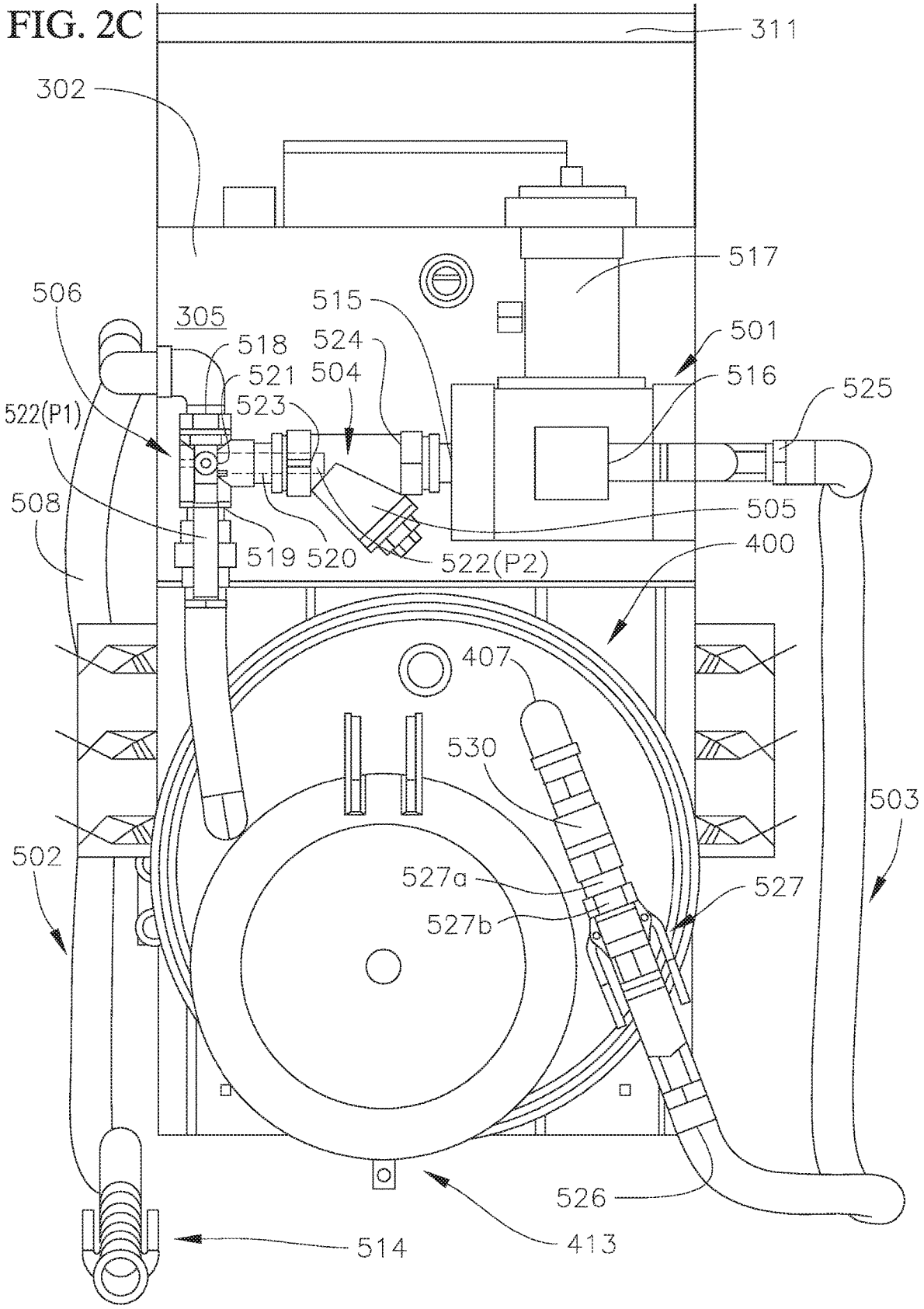
Figure 2D:
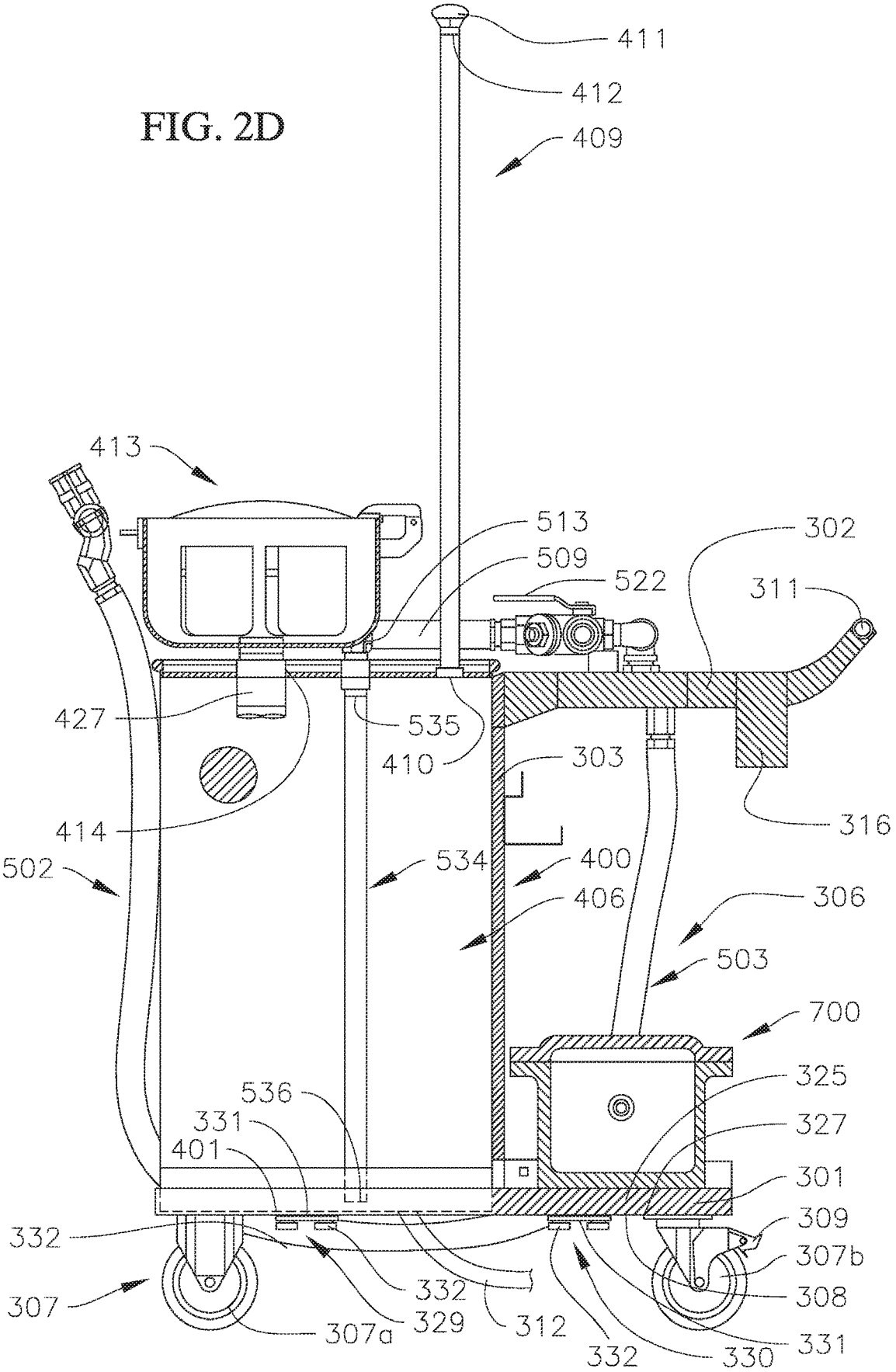
Figure 2E:
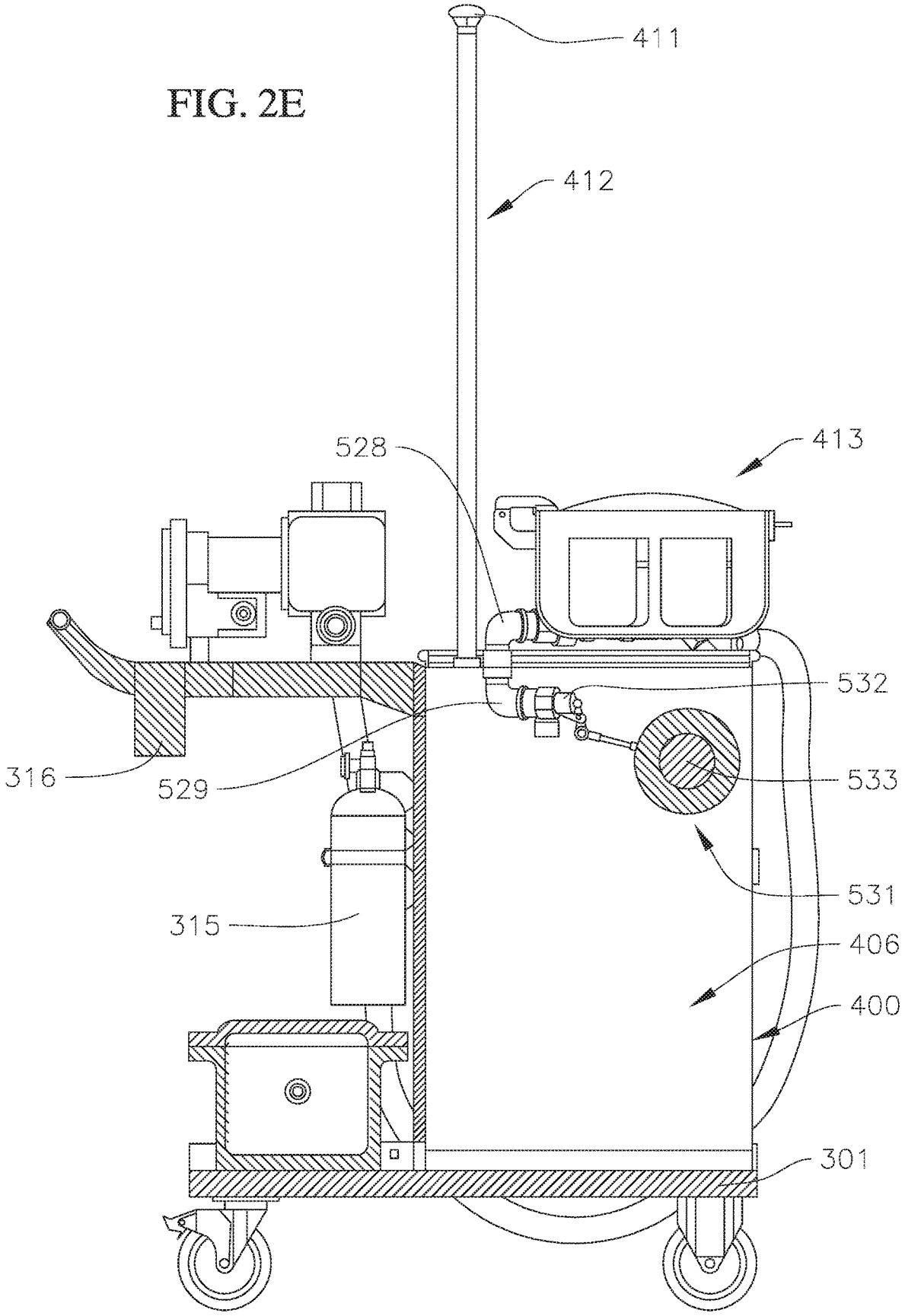
Figure 2F:
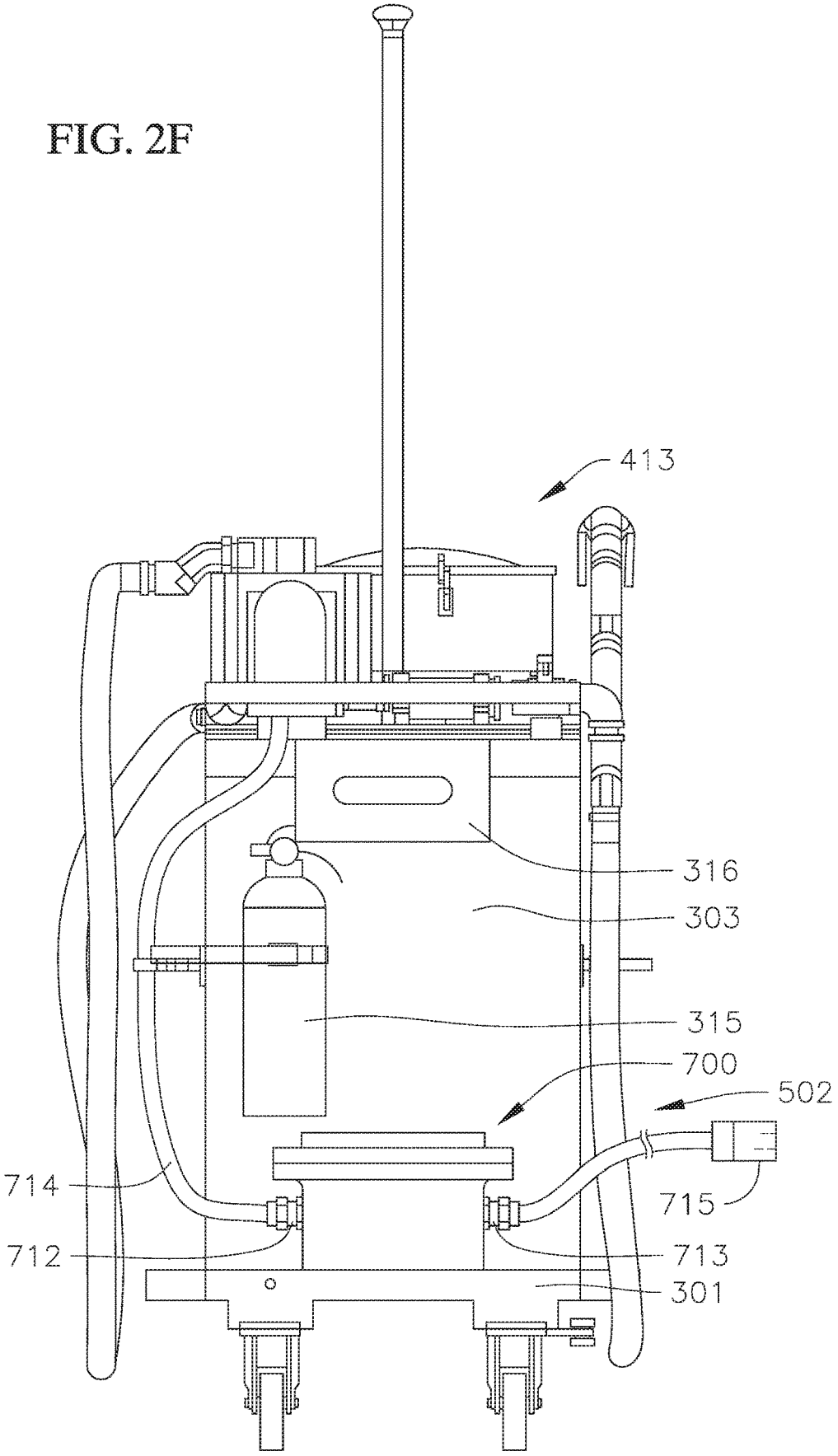
Figure 3A:
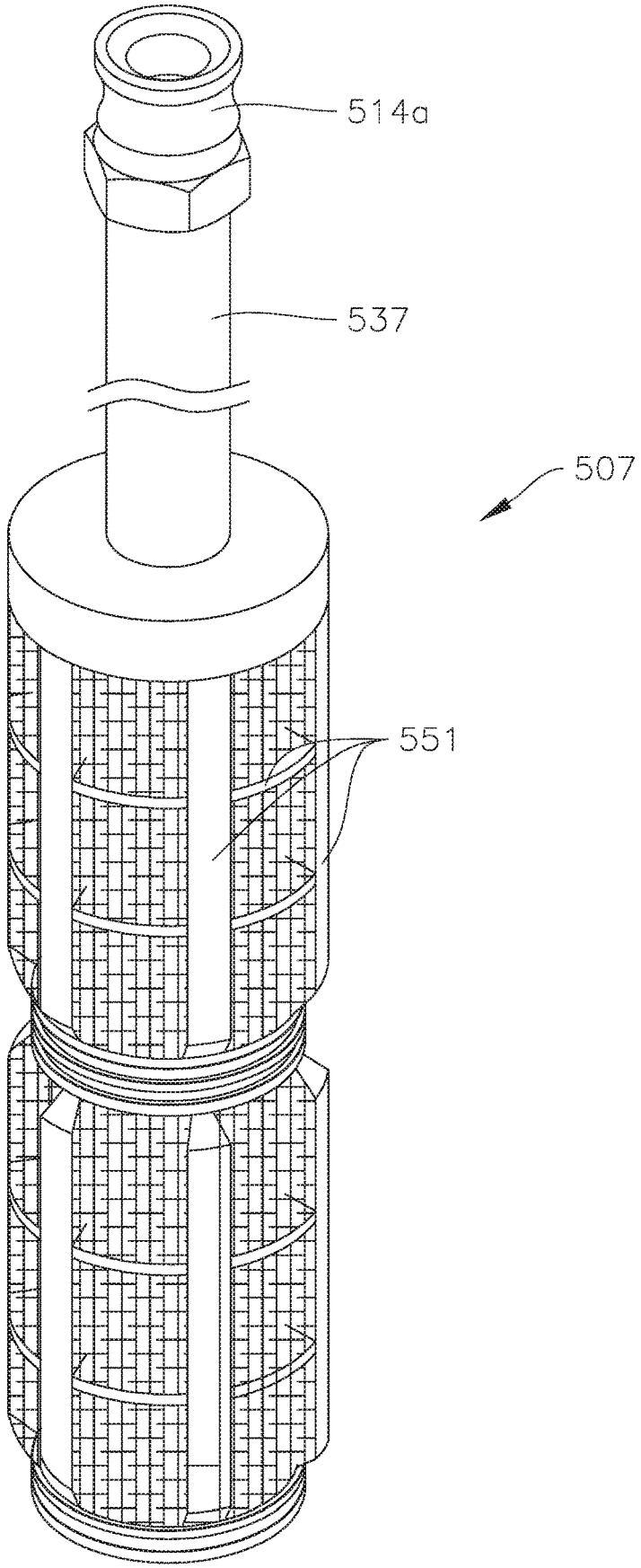
FIGS. 3A-3D are a perspective view, a side view, a cross-sectional view, and an enlarged detail view, respectively, of a nozzle of the portable pump and fuel containment system according to one embodiment of the present disclosure.
Figure 3B:
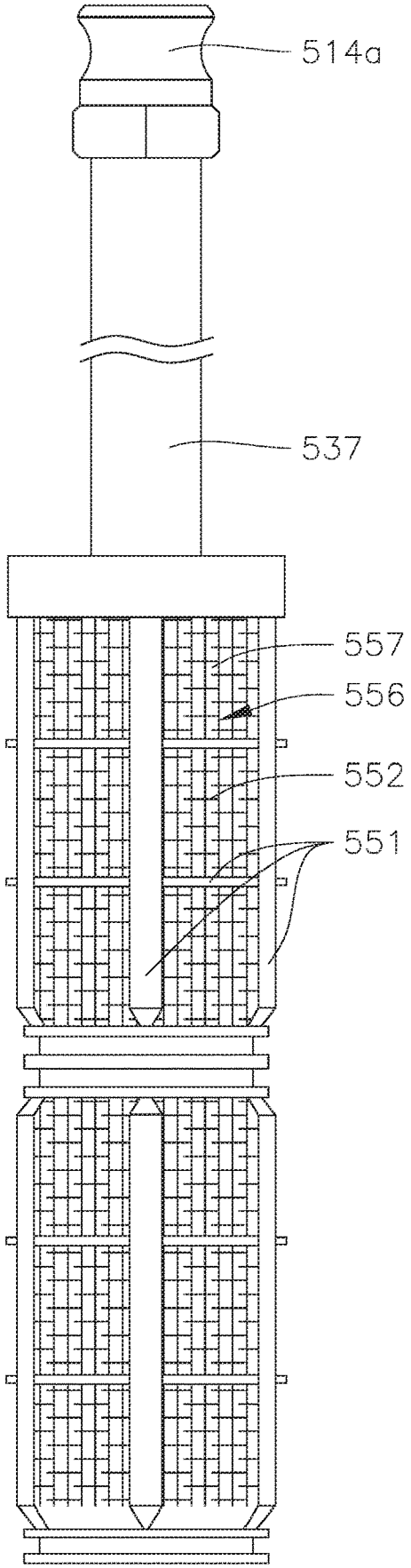
Figure 3C:
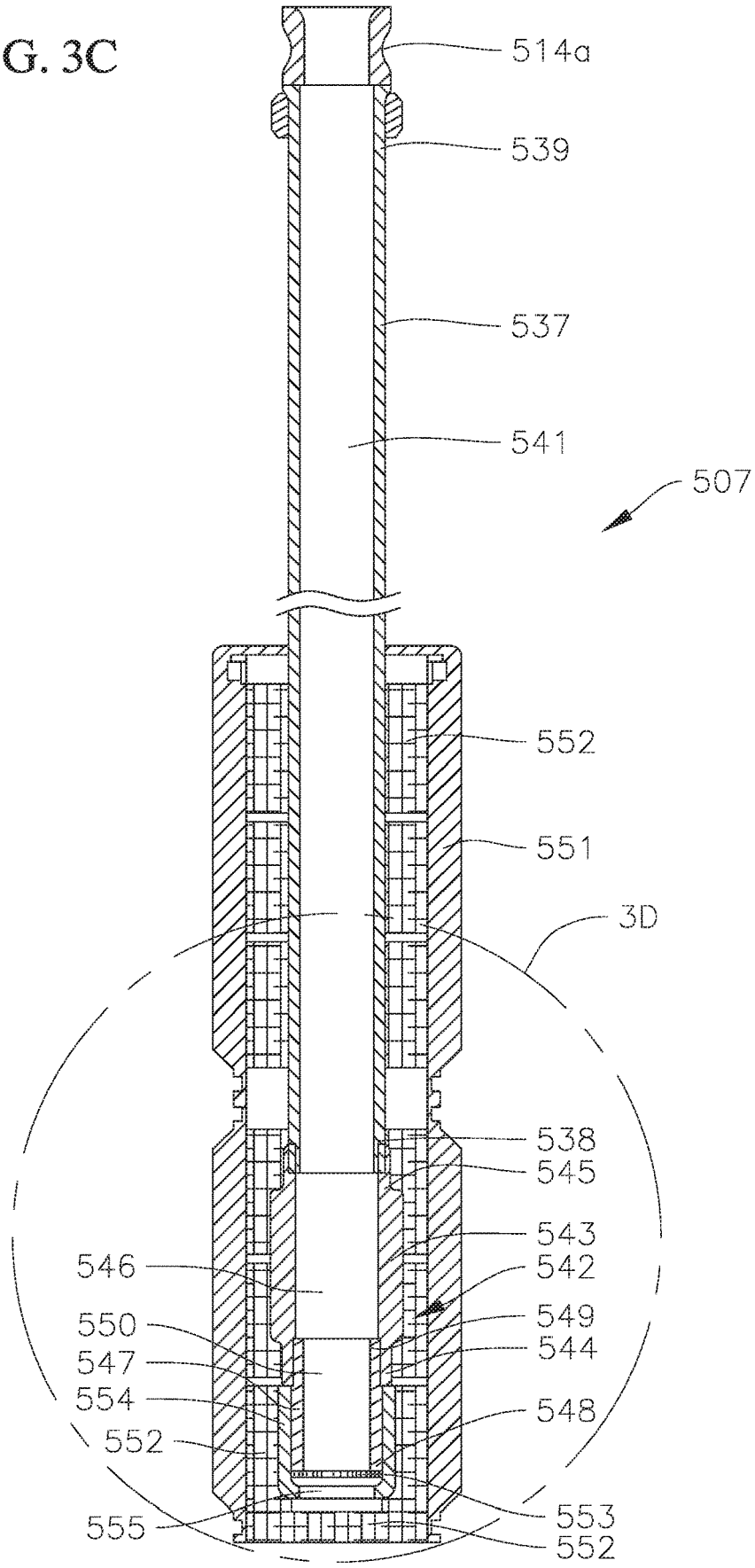
Figure 3D:
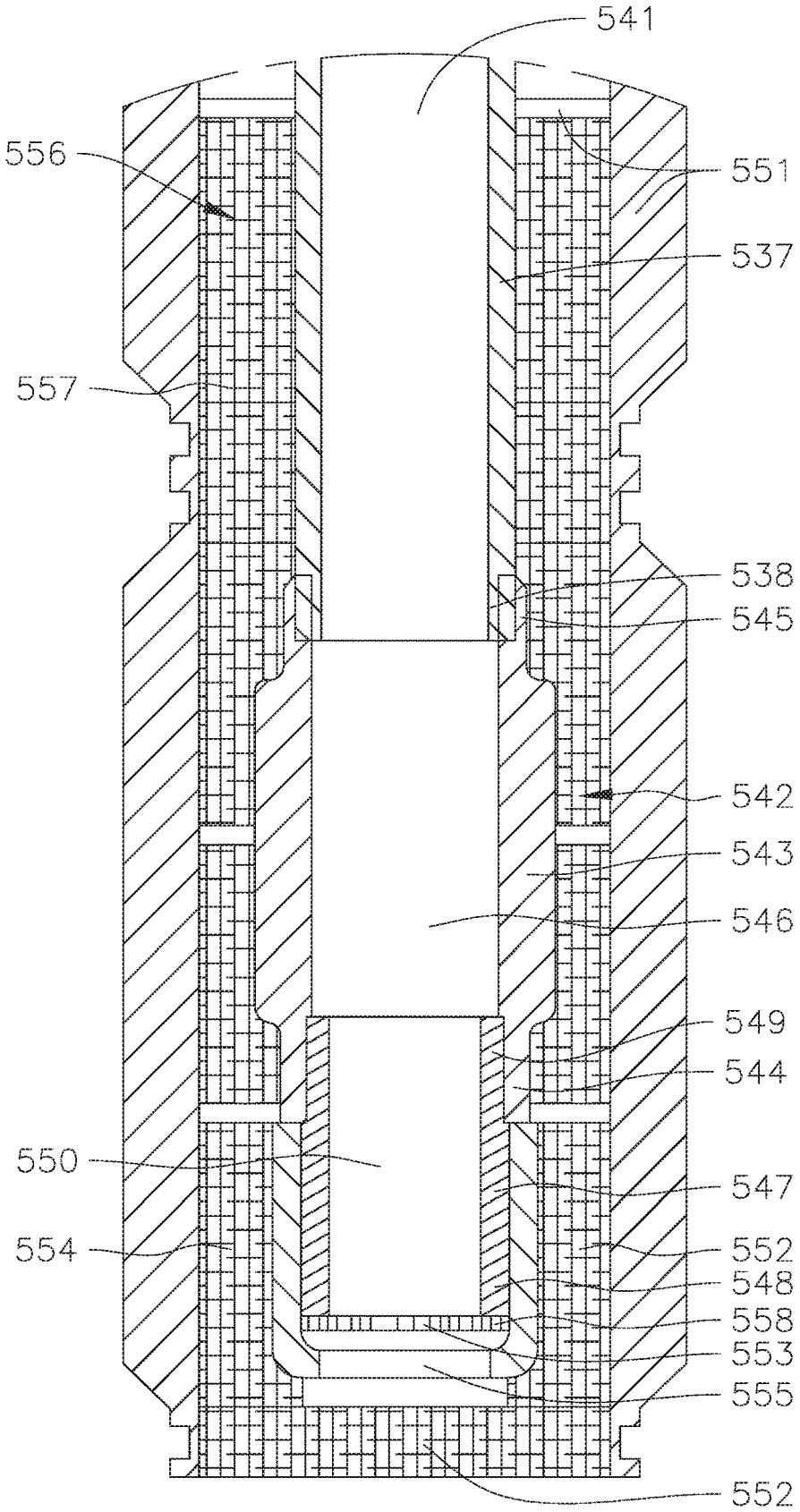

In the illustrated embodiment, the flexible return line 503 includes a first end 525 coupled to the outlet 516 of the pump 501, and a second end 526 opposite the first end 525 coupled to or extending through the inlet port 407 of the container 400 (i.e., the flexible return line 503 extends between the outlet 516 of the pump 501 and the inlet port 407 of the container 400). In the illustrated embodiment, the second end 526 of the flexible return line 503 is detachably coupled to the inlet port 407 of the container 400 with a detachable coupling 527 (e.g., a quick-release connector including male and female cam locks 527*a*, 527*b*). Additionally, in the illustrated embodiment, the liquid-transfer assembly 500 includes a series of connectors coupled to the detachable coupling 527 and the second end 526 of the flexible return line 503 and extending through the inlet port 407 of the container 400 and into the interior volume 406 of the container 400. In the illustrated embodiment, the connectors include a first elbow pipe fitting 528 coupled to the inlet port 407 of the container 400 outside of the interior volume 406 of the container 400, and a second elbow pipe fitting 529 coupled to the inlet port 407 of the container 400 inside the interior volume 406 of the container 400, as best shown in FIG. 2E. In one or more embodiments, the connectors connecting the second end 526 flexible return line 503 and the detachable coupling 527 to the inlet port 407 of the container 400 and extending into the interior volume 406 of the container 400 may be any other suitable type or kind of connectors.

In the illustrated embodiment, the liquid-transfer assembly 500 also includes a check valve (e.g., one-way valve) 530 connected between the detachable coupling 527 and the first elbow pipe fitting 528. The check valve 530 is configured to permit fluid to flow from the flexible return line 503 and into the interior volume 406 of the container 400 through the inlet port 407 of the container 400 but prevent fluid (e.g., liquid and/or gas) from flowing out of the interior volume 406 of the container 400 and into the flexible return line 503 (or into the atmosphere if the flexible return line 503 is disconnected at the detachable coupling 527). Preventing fluid (e.g., liquid and/or gas) from flowing out of the interior volume 406 of the container 400 is configured to prevent (or at least mitigate against) vapor communication with the interior volume 406 of the container 400, which might otherwise result in a dangerous condition in which a spark could create a combustion event.

In the illustrated embodiment, the liquid-transfer assembly 500 also includes a ball float valve 531 inside the interior volume 406 of the container 400 and coupled to the second elbow pipe fitting 529. The ball float valve 531 includes a valve 532 and a ball 533 coupled to the valve 532, as shown in FIG. 2E. When the level of the liquid in the interior volume 406 of the container 400 is below the ball 533, the valve 532 is in the open position such that additional fluid may be pumped into the interior volume 406 of the container 400. When the level of the liquid in the interior volume 406 of the container 400 reaches the height of the ball 533, the ball 533 begins to float, and the continued introduction of liquid (e.g., fuel or fuel-contaminated liquid) into the interior volume 406 of the container 400 causes the ball 533 to rise, which causes the valve 532 to close such that additional fluid may not be pumped into the interior volume 406 of the container 400. In this manner, the ball float valve 531 is configured to prevent the overfill and/or the over-pressurization of the container 400.

In one or more embodiments, the container 400 may also include a fill gauge configured to convey information regarding the remaining liquid capacity of the interior volume 406 of the container 400. In one or more embodiments, the fill gauge may be a mechanical float (e.g., ball float) configured to allow an operator to monitor the liquid level in the interior volume 406 of the container 400.

Additionally, in the illustrated embodiment, the liquid-transfer assembly 500 includes a drop pipe (or outlet pipe) 534 in the interior volume 406 of the container 400. In the illustrated embodiment, the drop pipe 534 has a first end 535 coupled to the second end 513 of the second transfer line segment 509 and a second end 536 opposite the first end 535 proximate to the bottom wall 401 of the container 400. Accordingly, in the illustrated embodiment, the drop pipe 534 extends from (or proximate to) the outlet port 408 down toward the bottom wall 401 of the container 400. In one or more embodiments, drop pipe 534 may be coupled to or pass through the outlet port 408 of the container 400. As described in more detail below, the drop pipe 534 enables the pump 501 to extract fuel or fuel-contaminated liquid from the interior volume 406 of the container 400. In one or more embodiments, the drop pipe 534 extends sufficiently toward the bottom wall 401 (e.g., the lower end of the drop pipe 534 is spaced apart from the bottom wall 401 of the container 400 by a distance in a range from approximately 1 inch to approximately ¼th inch) of the container 400 to extract all or substantially all of the fuel or fuel-contaminated liquid from the interior volume 406 of the container 400. In one or more embodiments, the drop pipe 534 may not extend sufficiently toward the bottom wall 401 to extract all or substantially all of the fuel or fuel-contaminated liquid from the interior volume 406 of the container 400. Although in the illustrated embodiment the outlet port 408 is provided in the upper wall 404 of the container 400, in one or more embodiments, the outlet port 408 may be provided in another wall of the container 400 (e.g., the outlet port 408 may be provided in the side wall 402 or the bottom wall 401). Depending on the position of the outlet port 408 in the container 400, in one or more embodiments, the drop pipe 534 may be omitted. For example, the drop pipe 534 may be omitted in an embodiment in which the outlet port 408 is provided in the bottom wall 401 or in a side wall 402 proximate to the bottom wall 401.

In the illustrated embodiment, the container 400 also includes a vent pipe 409 (or riser) configured to vent fumes from the interior chamber 406 of the container 400 and to maintain the interior chamber 406 at atmospheric or substantially atmospheric pressure. In the illustrated embodiment, the vent pipe 409 extends upward (or vertically) from a vent 410 (e.g., a hole) in the upper wall 404 of the container 400. In one or more embodiments, the vent 410 and the vent pipe 409 may be provided at any other suitable location on the container 400. In the illustrated embodiment, the vent pipe 409 has a height sufficient to release vapors above the head of an operator. For instance, in one or more embodiments, the vent pipe 409 may have a height in a range from approximately 30 inches to approximately 72 inches. In one or more embodiments, the container 400 also includes a spark arrester 411 at an upper end 412 of the vent pipe 409 to prevent (or at least mitigate against) combustion of the fuel vapors escaping from the vent pipe 409.

With reference now to the embodiment illustrated in FIGS. 2A-2F and 5, the container 400 also includes a filter bucket 413 coupled to a port 414 (e.g., an opening) in the upper wall 404 of the container 400. In the illustrated embodiment, the filter bucket 413 includes a housing 415 having a base wall 416 and at least one sidewall 417 extending up from the base wall 416. In the illustrated embodiment, the filter bucket 413 also includes a lid 418 hingedly coupled to an upper end 419 of the at least one sidewall 417 by a hinge 420. Together, the housing 415 and the lid 418 define an interior chamber 421. The lid 418 is configured to rotate between an open position in which the interior chamber 421 of the filter bucket 413 is accessible, and a closed position in which the interior chamber 421 of the filter bucket 413 is not accessible. In the illustrated embodiment, the filter bucket 413 also includes a clasp 422 on the lid 418 and a corresponding clasp 423 on the housing 415. Each of the clasps 422, 423 includes an opening 424, 425, respectively, configured to receive a lock to secure the lid 418 in the closed position.

Additionally, in the illustrated embodiment, the base wall 416 of the housing 415 includes an opening 426 (e.g., a hole) in communication with the interior chamber 421, and a filter pipe or conduit 427 connecting the opening 426 in the housing 415 of the filter bucket 413 to the port 414 in the container 400. Accordingly, the pipe 427 places the interior chamber 421 of the filter bucket 413 in fluid communication with the interior volume 406 of the container 400. In one or more embodiments, the filter pipe 427 may extend down into interior volume 406 of the container 400.

In the illustrated embodiment, the filter bucket 413 also includes a series of mesh filters. In the illustrated embodiment, the filter bucket 413 includes a main filter 428 and one or more support filters 429 (e.g., 100 mesh filters) housed in the interior chamber 421. In the illustrated embodiment, the main filter 428 and the one or more support filters 429 rest on top of one another above the base wall 416 of the housing 415. In one or more embodiments, the main filter 428 has a different number of holes per square inch (e.g., not a 100 mesh filter) than the one or more support filters 429. Additionally, in the illustrated embodiment, the filter bucket 413 includes a mesh filter 430 in the filter pipe 427. In use, an operator may open the lid 418, place fuel-contaminated objects (such as saturated fuel filters and rags) in the interior volume 406 of the filter bucket 413, close the lid 418, and allow gravity to drain liquid from the fuel-contaminated objects through the mesh filters 428, 429, and 430 into the interior volume 406 of the container 400.

With reference now to the embodiment illustrated in FIGS. 3A-3D, the nozzle 507 (e.g., the stinger) includes a body 537 (e.g., a pipe) having a first end 538 and a second end 539 opposite the first end 538. In one or more embodiments, the second end 539 of the body 537 of the stinger 507 is configured to detachably connect to the first end 510 of the first transfer line segment 508 of the flexible transfer line 502 with the detachable fitting 514 (e.g., the male cam lock male cam lock 514*a*, which is configured to be detachably connected to the female cam lock 514*b*, is coupled to the second end 539 of the body 537 of the stinger 507). In one or more embodiments, the body 537 is rigid and defines a passage 541 extending through the body 537 from the first end 538 to the second end 539. In the illustrated embodiment, the stinger 507 also includes a filter cap assembly 542 attached to the first end 538 of the body 537. In one or more embodiments, the filter cap assembly 542 includes a one-way valve 543 (e.g., an inline check valve) having a first end 544, a second end 545, and a passage 546 extending from the first end 544 to the second end 545, a pipe nipple 547 having a first end 548, a second end 549, and a passage 550 extending from the first end 548 to the second end 549, and a series of filters (described in more detail below). In the illustrated embodiment, the second end 545 of the one-way valve 543 is attached to the first end 538 of the body 537, the second end 549 of the pipe nipple 547 is attached to the first end 544 of the one-way valve 543, and the series of filters are coupled to the first end 548 of the pipe nipple 547. In one or more embodiments, the series of filters overlap in a flow direction (e.g., in a direction from outside the filter cap 542, through the pipe nipple 547, through the one-way valve 543, and into the body 537 of the stinger 507, etc.). In one or more embodiments, the one-way valve 543 is configured to allow fluid flow only into the body 537 (but not out of the body 537) of the stinger 507. In one or more embodiments, the filter cap assembly 542 of the stinger 507 and/or the body 537 of the stinger 507 may be composed of aluminium. In one or more embodiments, the body 537 of the stinger 507 has a length in a range from about 2 feet to about 7 feet.

As shown in the embodiment depicted in FIGS. 3A-3D, the series of filters includes a primary filter 551, a secondary filter 552, and a tertiary filter 553. In the illustrated embodiment, the tertiary filter 553 covers the passage 550 at the first end 548 of the pipe nipple 547. In one or more embodiments, the tertiary filter 553 is coupled to the first end 548 of the pipe nipple 547 by a pipe cap (e.g., a PVC cap) 554 which fits onto the first end 548 of the pipe nipple 547 with the tertiary filter 553 between the pipe nipple 547 and the pipe cap 554. In one or more embodiments, the pipe cap 554 has a through-hole 555 configured to allow fluid to flow from outside the pipe cap 554, through the tertiary filter 553, and into the passage 550 of the pipe nipple 547. In one or more embodiments, the secondary filter 552 covers the pipe cap 554, the pipe nipple 547, the one-way valve 543, and/or the body 537 of the stinger 507 in a direction normal to the circumference of the pipe cap 554, the pipe nipple 547, the one-way valve 543, and/or the body 537 of the stinger 507 (e.g., the secondary filter 552 circumferentially covers the pipe cap 554, the pipe nipple 547, the one-way valve 543, and a portion of the body 537 of the stinger 507). In one or more embodiments, the primary filter 551 covers the secondary filter 552, the pipe cap 554, the pipe nipple 547, the one-way valve 543, and/or the body 537 of the stinger 507 in the direction normal to the circumference of the pipe cap 554, the pipe nipple 547, the one-way valve 543, the body 537 of the stinger 507, and/or the secondary filter 552 (e.g., the primary filter 551 circumferentially covers the secondary filter 552, the pipe cap 554, the pipe nipple 547, the one-way valve 543, and a portion of the body 537 of the stinger 507).

In one or more embodiments, the series of filters have pores of decreasing area in the flow direction. For example, in the illustrated embodiment, the primary filter 551 includes a plurality of through-holes or pores 556 having a first mesh size, the secondary filter 552 includes a plurality of through-holes or pores 557 having a second mesh size smaller than the first mesh size of the primary filter 551, and the tertiary filter 553 includes a plurality of through-holes or pores 558 having a third mesh size smaller than the third mesh size of the secondary filter 552 (e.g., the series of filters 551, 552, 553 have through-holes 556, 557, 558, respectively, decreasing in area along the flow direction to filter out sequentially smaller particulates). In one or more embodiments, the third mesh size of the tertiary filter 553 is in a range from approximately 80 mesh to approximately 120 mesh. As used herein, the term "mesh size" refers to the number of openings in one linear inch of screen. When fluid (e.g., liquid and/or gas) flows into the filter cap 542, the fluid first contacts the primary filter 551 followed by the secondary filter 552 followed by the tertiary filter 553. Therefore, in one or more embodiments, the filtration from outside the stinger 507 into the passage 541 of the body 537 of the stinger 507 (i.e., in a flow direction) shifts or transitions from the coarsest mesh to the finest mesh. In one or more embodiments, the primary filter 551 has greater durability than the secondary filter 552, and the secondary filter 552 has greater durability than the tertiary filter 553. For example, in one or more embodiments, the primary filter 551 has a greater thickness in the flow direction than the thickness of the secondary filter 552 and/or the thickness of the secondary filter 552 is greater than the thickness of the tertiary filter 553 in the flow direction. Further, the primary filter 551, the secondary filter 552, and/or the tertiary filter 553 may be composed of different materials. In the manner described above, the filter cap 542 enables the stinger 507 to filter particulates from a fluid or gas flowing into the first transfer line segment 508 of the flexible transfer line 502.

In operation, liquid, such as fuel, may be pumped from a containment sump (e.g., an under dispenser containment (UDC) unit) and into the interior volume 406 of the container 400 by inserting the nozzle 507 (e.g., the stinger) into the liquid in the containment sump, moving or ensuring that the three-way control valve 506 is in the first position P1 (e.g., rotating the lever 522 such that the three-way control valve 506 is in the first position P1), and actuating the pump 501. In this manner, the fluid in the containment sump flows through the nozzle 507 (and the primary, secondary, and tertiary filters 551, 552, 553 contained therein), through the first transfer line segment 508, through the first inlet 518 of three-way control valve 506, out through the outlet 520 of the three-way control valve 506, through the y-valve 504 (and the y-filter 505 contained therein), through the pump 501, through the flexible return line 503, and into the interior volume 406 of the container through the inlet port 407 of the container 400.

To withdraw the fluid stored in the interior volume 406 of the container 400 (e.g., to dispose of the fuel or the fuel-contaminated liquid in the interior volume 406 of the container 400), the second end 526 of the flexible return line 503 may be detached from the inlet port 407 of the container 400 (e.g., by disconnecting the male and female cam locks 527*a*, 527*b*, respectively, of the detachable connector 527), inserting the second end 526 of the return line 503 into a disposal bin or other waste receptacle, moving or ensuring that the three-way control valve 506 is in the second position P2, and actuating the pump 501. In this manner, the fluid in the interior volume 406 of the container 400 flows out through the outlet port 408 of the container 400, through the second transfer line segment 509 of the flexible transfer line 502, through the second inlet 519 of the three-way control valve 506, out through the outlet 520 of the three-way control valve 506, through the y-valve 504 (and the y-filter 505 contained therein), through the pump 501, and out through the return line 503 and into the disposal bin or other waste receptacle into which the second end 526 of the return line 503 is inserted.

With continued reference to the embodiment illustrated in FIGS. 2A-2F, the portable base assembly 300 includes a base or a lower support 301, an upper support 302 above the lower support 301, and a partition 303 extending between and connecting the lower support 301 to the upper support 302. In the illustrated embodiment, the container 400 and the battery assembly 700 are supported on an upper surface 304 of the lower support 301, and the pump 501 and the y-valve 504 are coupled to the upper support 302 (e.g., supported on an upper surface 305 of the upper support 302). Together, the lower support 301, the upper support 302, and the partition 303 define (or partially surround) an isolation zone (or shielded zone) 306. In the illustrated embodiment, the battery assembly 700 is located in the isolation zone 306 and the container 400 is located outside of the isolation zone 306 (i.e., the battery assembly 700 and the container 400 are on opposite sides of the partition 303). Accordingly, the isolation zone 306 is configured to isolate the battery assembly 700 from the container 400 and thereby eliminate or at least mitigate a risk that a spark from the battery assembly 700 could ignite fuel or fuel vapor contained in, or emanating from, the container 400. Additionally, in the illustrated embodiment, the portable base assembly 300 also includes a series of wheels 307 (e.g., caster wheels) coupled to a lower surface 308 of the lower support 301. The wheels 307 enable transportation of the portable pump and fuel containment system 200 to a desired location and into a desired orientation. Additionally, in one or more embodiments, the wheels 307 may be rubber wheels configured to enable the portable pump and fuel containment system 200 to pass over uneven (e.g., bumpy) terrain and to dampen vibrations transmitted from the pump 501. The portable base assembly 300 may include any suitable number of wheels 307, and the wheels 307 may be any suitable type or kind of wheels or combination of types or kinds of wheels. In the illustrated embodiment, the portable base assembly 300 has four wheels 307, including two wheels 307*a* proximate to a front end of the lower support 301 and two wheels 307*b* proximate to a rear end of the lower support 301. In the illustrated embodiment, the portable base assembly 300 also includes a pair of brakes or locks 309 coupled to the two wheels 307*b* proximate to the rear end of the lower support 301. When activated, the locks 309 are configured prevent the two wheels 307*b* from rotating and thereby prevent the portable pump and fuel containment system 200 from inadvertently moving. Additionally, in the illustrated embodiment, the container 400 is secured to the portable base assembly 300 by a band 310 (e.g., a sheet metal band) extending around the container 400 and coupled to the partition 303.

In the illustrated embodiment, the portable base assembly 300 also includes a handlebar 311 coupled to the upper support 302 to enable an operator to push or pull the portable base assembly 300. In one or more embodiments, the handlebar 311 is located above the two wheels 307*b* proximate to the rear end of the lower support 301. Although in the illustrated embodiment the handlebar 311 is a single straight rod, in one or more embodiments the handlebar 311 may have any other suitable configuration to enable an operator to move the portable base assembly 300. In one or more embodiments, the handlebar 311 may be at a height ranging from approximately the elbow height to approximately the shoulder height of an average adult operator standing in a relaxed position. In one or more embodiments, the pump 501 and the three-way control valve 506, which are coupled to the upper support 302, are in close proximity to the handlebar 311. Therefore, the pump 501, the three-way control valve 506, and the handlebar 311 are within arm's reach of an operator.

In one or more embodiments, the portable base assembly 300 may also include one or more grounding devices configured to ground the portable pump and fuel containment system 200 and thereby mitigate against the risk of a combustion event due to static discharge. In the illustrated embodiment, the portable base assembly 300 includes a grounding strap 312 coupled to the lower support 301 and configured to drag on the ground to provide continuous grounding. In one or more embodiments, the portable base assembly 300 may include a conductive, flexible helical line 313 (also shown in FIG. 2A) coupled to the lower support 301 of the portable base assembly 300 and attached to a pinch clamp 314. The pinch clamp 314 is configured to connect to, or clamp to, a grounded device or structure, such as a conductive rod extending into the ground. In one or more embodiments, the portable base assembly 300 may include any other suitable grounding device or combination of two or more grounding devices.

In the illustrated embodiment, the portable base assembly 300 also includes a fire extinguisher 315 coupled to the partition 303 in the isolation zone 306, and a glove box 316 configured to hold various items (e.g., gloves) coupled to the upper support 302. In the illustrated embodiment, the fire extinguisher 315 is detachably coupled to the partition 303 in the isolation zone 306 and within arm's reach of an operator. In one or more embodiments, the glove box 316 may be detachably coupled to the upper support 302 of the portable base assembly 300.

In the illustrated embodiment, the portable base assembly 300 also includes a trough or support tray 317 coupled to the lower support 301 and a series of clamps or straps 318 coupled to the band 310 securing the container 400 to the portable base assembly 300 and aligned or substantially aligned above the support tray 317. Together, the support tray 317 and the clamps 318 are configured to hold the stinger 507, one or more extension pipes 559 (e.g., an extension pipe having a length in a range from about 2 feet to about 7 feet), and/or one or more additional nozzles 560 (e.g., an additional nozzle including a body having a length in a range from about 2 feet to about 7 feet). The extension pipe 559 and/or the additional nozzle 560 may be selectively coupled to the first end 510 of the first transfer line segment 508 of the flexible transfer line 502 (e.g., by attaching the extension pipe 559 and/or the additional nozzle 560 to the coupling 514 at the first end 510 of the first transfer line segment 508).

In the illustrated embodiment, the lower support 301 of the portable base assembly 300 includes a base plate 319, and an upwardly-extending lip 320 extending around an outer periphery (e.g., a perimeter) of the base plate 319. In the illustrated embodiment, the base plate 319 is rectangular, and the upwardly-extending lip 320 includes a rear lip segment 321 extending along a rear edge 322 of the base plate 319, a front lip segment 323 extending along a front edge 324 of the base plate 319, and a pair of opposing side lip segments 325, 326 extending along side edges 327, 328, respectively, of the base plate 319. Additionally, in the illustrated embodiment, the portable base assembly 300 includes at least one crane roller (i.e., at least one track roller), which, as described in more detail below, may be utilize to safely secure the portable pump and fuel containment system 200 during transportation in or on a vehicle. In the illustrated embodiment, the portable base assembly 300 includes a pair of crane rollers 329, 330 coupled to the lower support 301 and spaced apart from each other along one side edge 327 of the base plate 319, although in one or more embodiments, the portable base assembly 300 may include any other suitable number of crane rollers, and the crane rollers 329, 330 may be provided along any other suitable portion of the lower support 301 (e.g., the crane rollers 329, 330 may be spaced apart from each other along the other side edge 328 of the base plate 319, along the front edge 324 of the base plate 319, or along the rear edge 322 of the base plate 319). In the illustrated embodiment, each of the crane rollers 329, 330 includes a bracket 331 coupled to the lower support 301 and a pair of rollers or wheels 332, 333 coupled to the bracket 331. In the illustrated embodiment, the wheels 332, 333 of each of the crane rollers 329, 330 project or extend beyond the side edge 327 of the base plate 319 and beyond the corresponding side lip segment 325.

Additionally, in the illustrated embodiment, the lower support 301 of the portable base assembly 300 also includes an opening 334 (e.g., a through-hole) in the front lip segment 323, and an opening 335 (e.g., a through-hole) in the rear lip segment 321. As described in more detail below, the openings 334, 335 may be utilized to safely secure the portable pump and fuel containment system 200 during transportation in or on a vehicle.

Figure 4A:
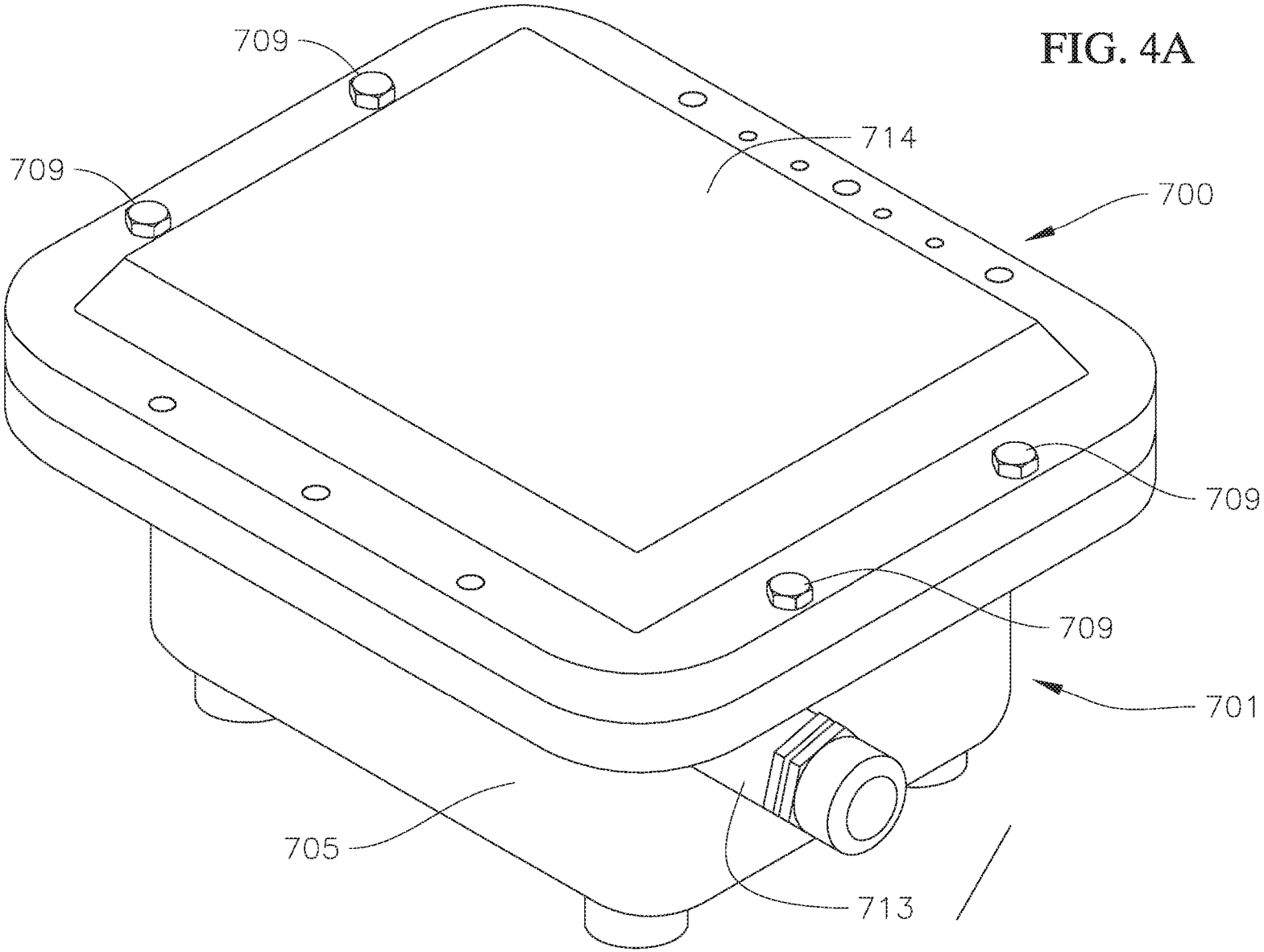
FIGS. 4A-4C are a perspective view, a top view, and a cross-sectional view, respectively, of a battery assembly of the portable pump and fuel containment system according to one embodiment of the present disclosure.
Figure 4B:
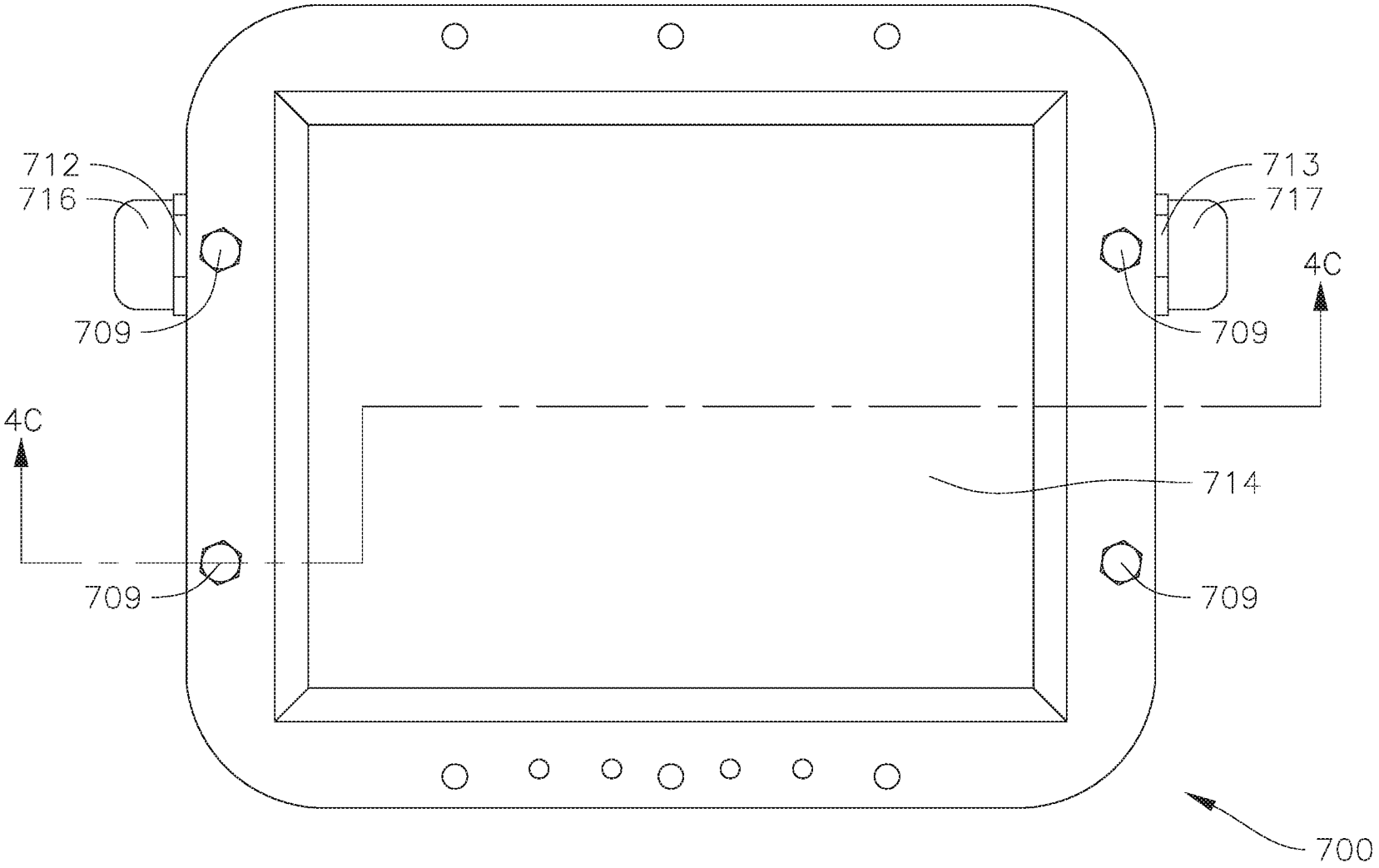
Figure 4C:
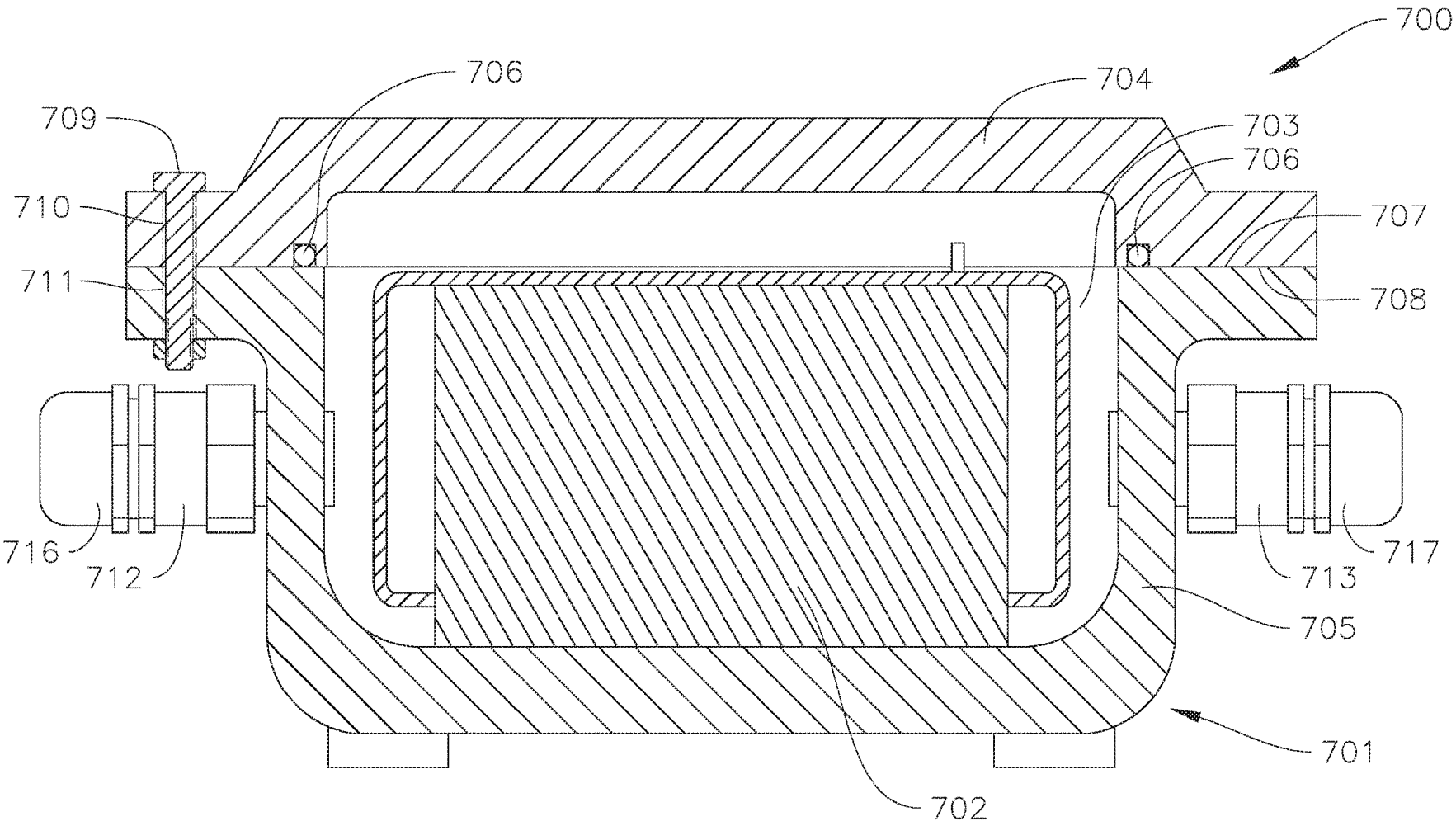
Figure 5:
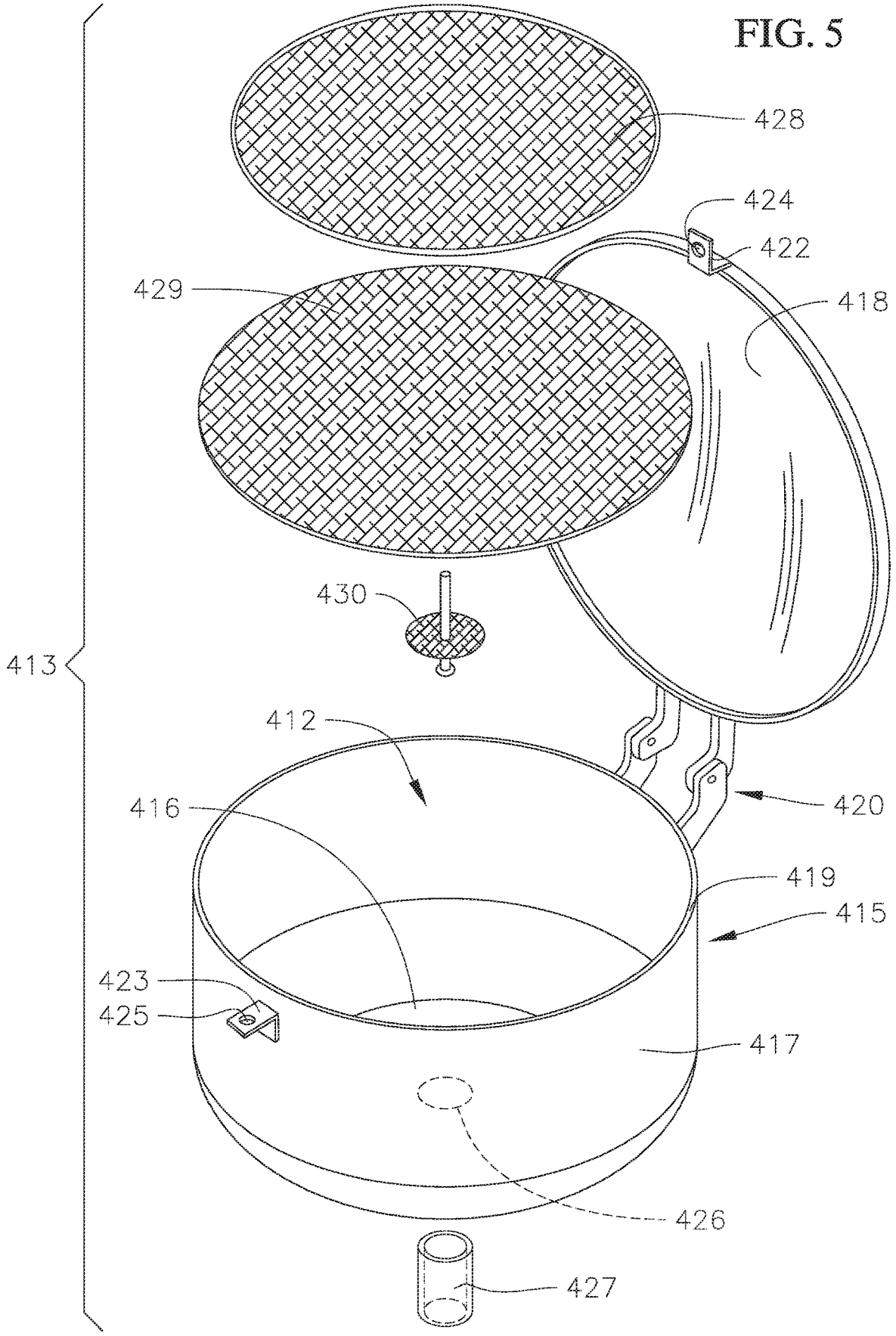
FIG. 5 is an exploded perspective view of a filter bucket of the portable pump and fuel containment system according to one embodiment of the present disclosure.
Figure 6A:
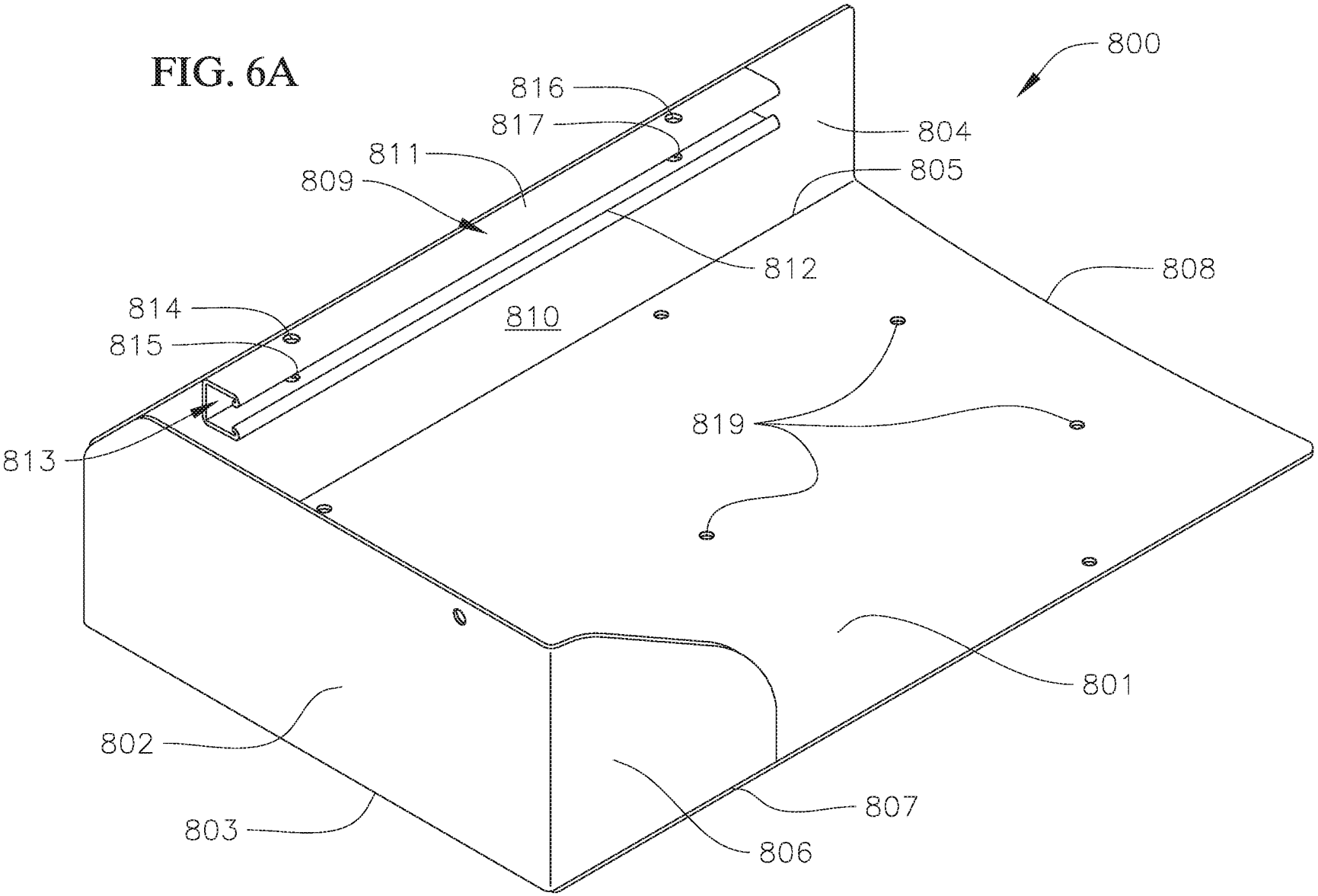
FIGS. 6A-6D are a perspective view, a top view, a side view, and a front view, respectively, of a mount according to one embodiment of the present disclosure configured to facilitate transportation of the portable pump and fuel containment system.
Figures 6B, 6C, 6D:
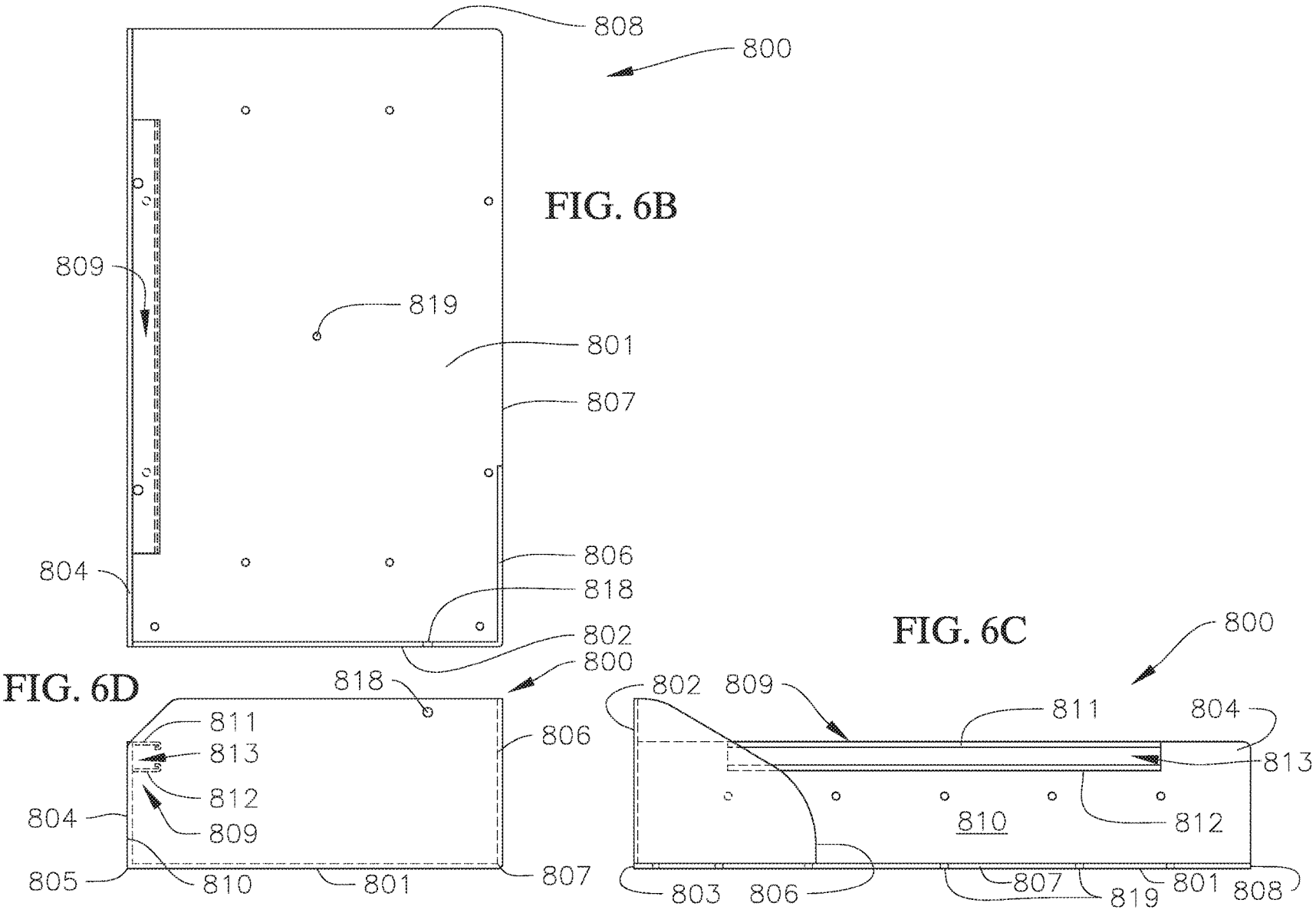

With reference now to the embodiment illustrated in FIGS. 4A-4C, the battery assembly 700 includes an explosion proof box 701 and at least one rechargeable battery 702 (i.e., at least one secondary battery) accommodated in an interior cavity or chamber 703 inside the explosion proof box 701. In one or more embodiments, the explosion proof box 701 includes an upper housing 704 (e.g., a lid) and a lower housing 705 that contact one another along a sealing interface 706 (e.g., a gasket) between a lower end 707 of the upper housing 704 and an upper end 708 of the lower housing 705. The upper housing 704 and the lower housing 705 may be secured together to form a seal at the sealing interface 706 by a series of fasteners 709 (e.g., bolts) inserted through a series of openings 710 (e.g., holes) in the upper housing 704 and into or through a corresponding series of openings 711 (e.g., holes) in the lower housing 705. In the illustrated embodiment, the battery assembly 700 also includes a first corrosion resistant fitting 712 coupled to the lower housing 705 configured to connect to a power port of the rechargeable battery 702 and a second corrosion resistant fitting 713 coupled to the lower housing 705 configured to connect to a charging port of the rechargeable battery 702. In the illustrated embodiments, the first corrosion resistant fitting 712 and the second corrosion resistant fitting 713 are on opposite sides or ends of the lower housing 705, although in one or more embodiments, the first corrosion resistant fitting 712 and the second corrosion resistant fitting 713 may be arranged in any other suitable configuration on the lower housing 705. In the illustrated embodiment, the battery assembly 700 also includes wire cable or harness 714 (see FIG. 2B) coupled at one end to the first corrosion resistant fitting 712 (which is coupled to the power port of the rechargeable battery 702) and at the other end to the electric motor 517 to deliver electrical power the pump 501. The second corrosion resistant fitting 713 enables the rechargeable battery 702 housed in the explosion proof box 701 to be charged and recharged by an external power source. In the illustrated embodiment, the battery assembly 700 includes a grounded female plug 715 (see FIG. 2B) coupled to the second corrosion resistant fitting 713 (which is coupled to the charging port of the rechargeable battery 702) such that an external power source, described in detail below, may be utilized to charge and recharge the at least one rechargeable battery 702 of the battery assembly 700. In the illustrated embodiment, the first corrosion resistant fitting 712 and the second corrosion resistant fitting 713 each include a detachable cap 716, 717, respectively, configured to protect the first corrosion resistant fitting 712 and/or the second corrosion fitting 713, respectively, when they are not externally connected to another device or structure.

Figure 8:
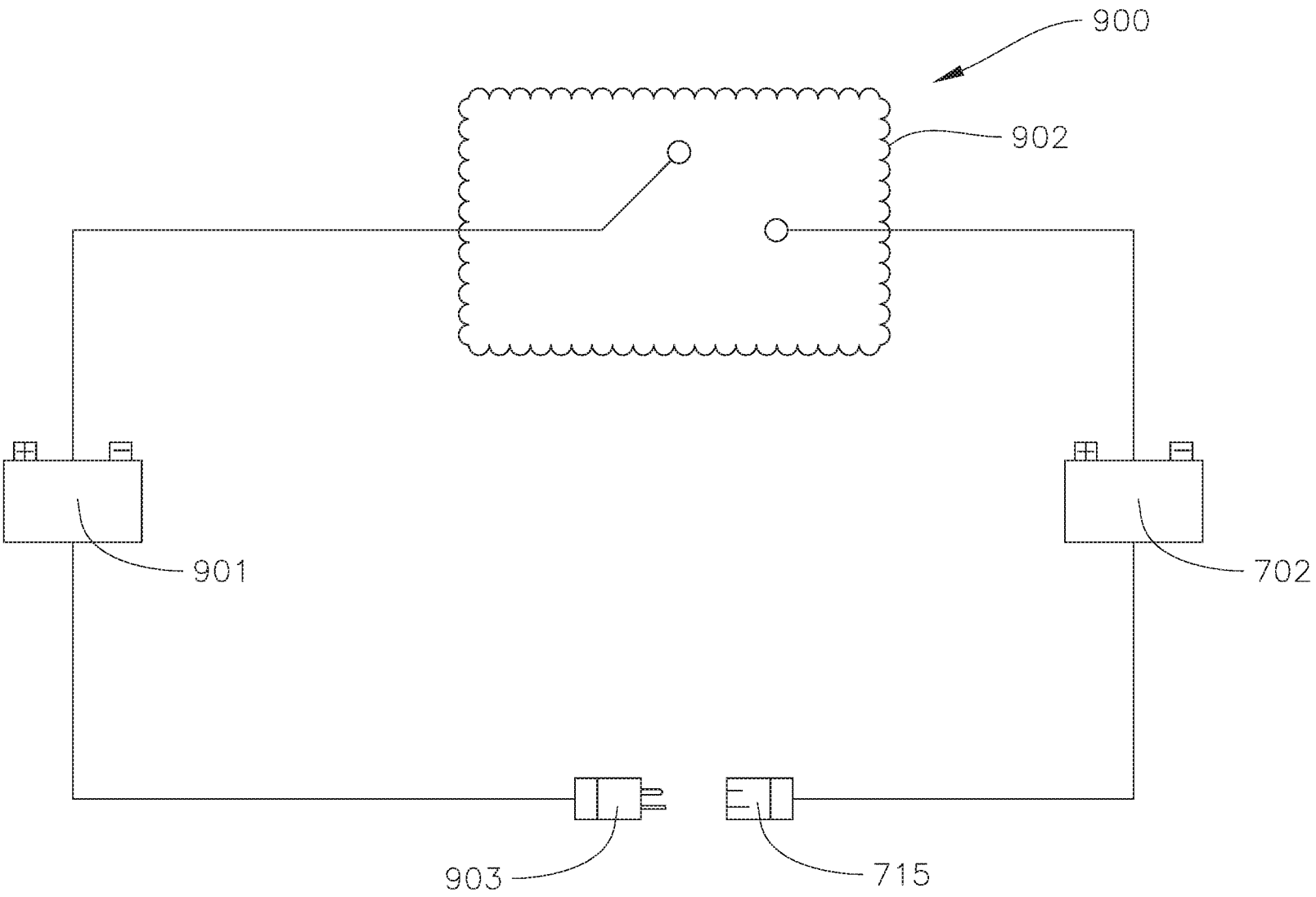
FIG. 8 is a schematic diagram of a vehicle charging system for charging the portable pump and fuel containment system according to one embodiment of the present disclosure.

FIG. 8 is a schematic diagram of a vehicle charging system 900 for charging and recharging the rechargeable battery 702 of the portable pump and fuel containment system 200 according to one embodiment of the present disclosure. In the illustrated embodiment, the vehicle charging system 900 includes a vehicle power source (e.g., a battery) 901 coupled to an ignition relay 902 of the vehicle (e.g., a service/testing truck), and a male plug 903 coupled to the vehicle power source 901. The male plug 903 of the vehicle charging system 900 is configured to be connected to the female plug 715 of the battery assembly 700 to charge or recharge the at least one rechargeable battery 702 of the portable pump and fuel containment system 200. The female plug 715 of the battery assembly 700 is configured to prevent a user or an operator from plugging the battery assembly 700 into a standard 10V AC wall socket.

Figure 9:
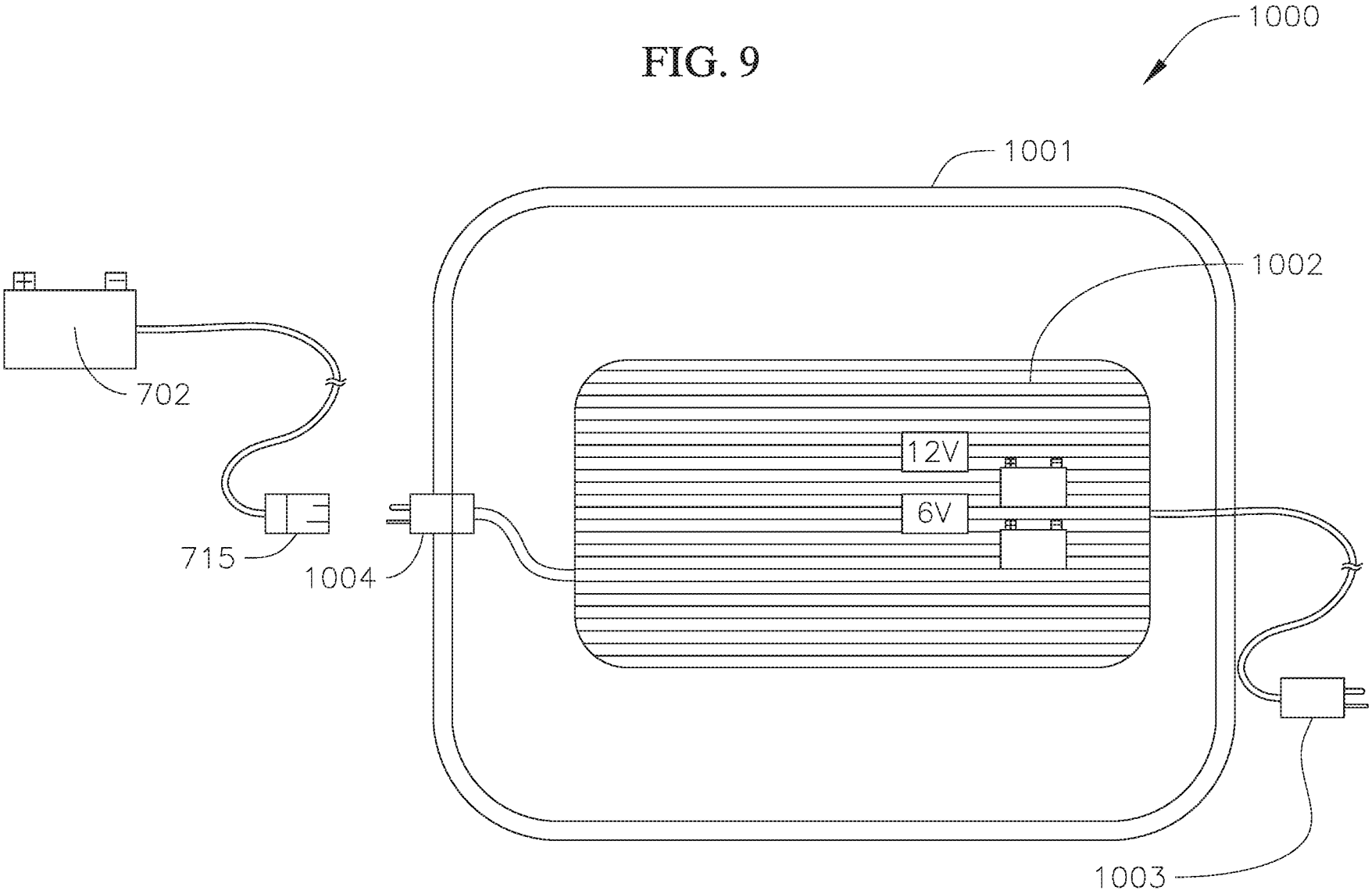
FIG. 9 is a schematic diagram of a charging system for charging the portable pump and fuel containment system according to another embodiment of the present disclosure.

FIG. 9 is a schematic diagram of a fixed charging system or station 1000 or charging and recharging the rechargeable battery 702 of the portable pump and fuel containment system 200 according to one embodiment of the present disclosure. In the illustrated embodiment, the fixed charging station 1000 includes an electrical box or housing 1001 configured to be mounted on the wall of a structure (e.g., a building at a gasoline service station) and a battery charger 1002 (e.g., a battery tender) housed inside of the electrical box 1001. Additionally, in the illustrated embodiment, the fixed charging station 1000 includes a male plug 1003 coupled to the battery charger 1002 and configured to be plugged into a 110V AC power socket in the building, and a grounded male plug 1004 coupled to the battery charger 1002 and configured to be connected to the female plug 715 of the battery assembly 700 to charge or recharge the at least one rechargeable battery 700 of the portable pump and fuel containment system 200. As described above, the female plug 715 of the battery assembly 700 is configured to prevent a user or an operator from plugging the battery assembly 700 into a standard 10V AC wall socket.

FIGS. 6A-6D depict an embodiment of a mount 800 configured to enable or facilitate safe transportation of the portable pump and fuel containment system 200 on or in a vehicle, such as in the flat bed of a truck. In the illustrated embodiment, the mount 800 includes a base plate 801, a front wall or lip 802 extending upward from a front edge 803 of the base plate 801, a first sidewall 804 extending upward from a first side edge 805 of the base plate 801, and a second sidewall 806 extending upward from a second side edge 807 of the base plate 801. In the illustrated embodiment, the second sidewall 806 is a partial sidewall (e.g., the second sidewall 806 does not extend along the entire length of the second side edge 807 of the base plate 801) and a wall or lip is not provided along a rear edge 808. Accordingly, the rear and a portion of the side of the mount 800 are open, which facilitates loading the portable pump and fuel containment system 200 onto the mount 800, as described in more detail below.

Additionally, in the illustrated embodiment, the mount 800 includes a channel section 809 (i.e., a strut channel) coupled to an interior surface 810 of the first sidewall 804. In the illustrated embodiment, the channel section 809 is oriented parallel or substantially parallel to the base plate 801 and extends parallel or substantially parallel to the first side edge 805 of the base plate 801. The channel section 809 includes an upper rail 811 and a lower rail 812 spaced below the upper rail 811. A channel 813 is defined between the upper and lower rails 811, 812. Additionally, in the illustrated embodiment, the mount 800 includes a first pair of aligned openings 814, 815 extending through the upper and lower rails 811, 812, respectively, and a second pair of aligned openings 816, 817 extending through the upper and lower rails 811, 812, respectively. In the illustrated embodiment, the first pair of aligned openings 814, 815 is proximate to the front wall 802 and the front edge 803, and the second pair of aligned openings 816, 817 are proximate to the rear edge 808 of the base plate. The first pair of aligned openings 814, 815 is configured to receive a first lock to secure the portable pump and fuel containment system 200 to the mount, and the second pair of aligned openings 816, 817 is configured to receive a second lock to secure the portable pump and fuel containment system 200 to the mount 800. In the illustrated embodiment, the front wall 802 of the mount 800 includes an opening 818 (e.g., a through hole) configured to receive a fastener for securing the portable pump and fuel containment system 200 to the mount 800. Additionally, in the illustrated embodiment, the base plate 801 of the mount 800 includes a series of openings 819 (e.g., holes) configured to receive fasteners for securing the mount 800 to a vehicle (e.g., to the flat bed of a truck). The mount 800 may be formed of any suitably strong and durable material, such as, for example, steel (e.g., 10 gauge (GA) galvanized steel).

In the illustrated embodiment, the mount 800 is intended to be installed along the right side of the flatbed of a vehicle, although in one or more embodiments the mount 800 may be configured to be installed along any other portion of the vehicle flatbed (e.g., the mount 800 have any other suitable configuration depending, for instance, on the orientation in which the mount 800 is intended to be installed in the vehicle). In the illustrated embodiment, the mount 800 may be installed in a vehicle by placing the mount 800 in the flatbed of a truck, orienting the front wall 802 facing toward the front of the vehicle, the rear edge 808 toward the rear of the vehicle, the first sidewall 804 facing toward or against a sidewall of the vehicle bed, and the second sidewall 806 facing toward an interior of the vehicle bed, and then installing fasteners through the openings 819 in the base plate 801 of the mount 800 and into the floor of the vehicle flatbed.

Figure 7:
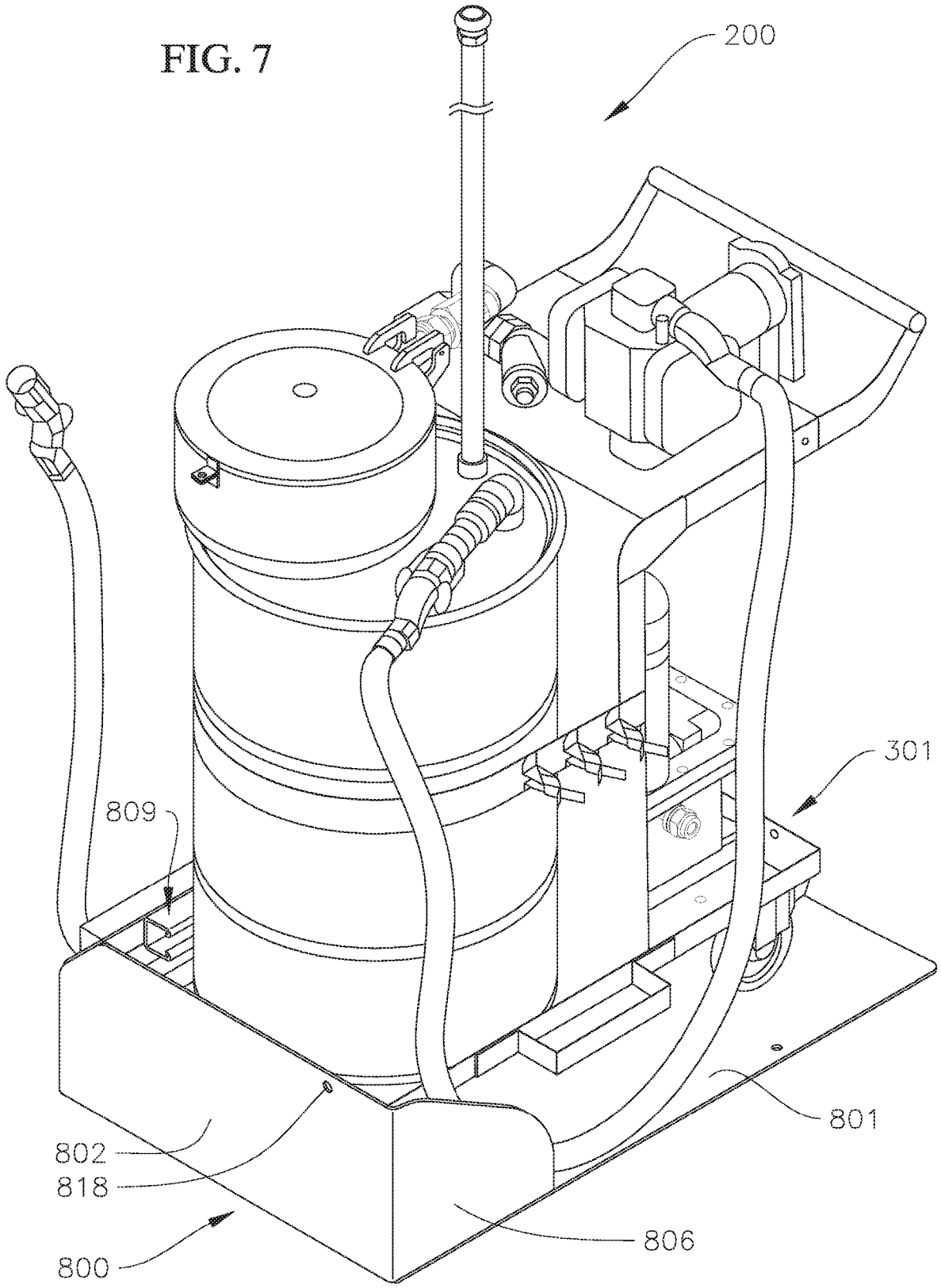
FIG. 7 is a perspective view depicting the portable pump and fuel containment system engaging the mount during transportation.

FIG. 7 depicts the portable pump and fuel containment system 200 engaging the mount 800. When the mount 800 is installed in a vehicle, the portable pump and fuel containment system 200 may be loaded onto the mount 800 by inserting the portable pump and fuel containment system 200 through the open rear end of the mount 800, and rolling the wheels 307 along the base plate 801 of the mount 800 such that the wheels 332, 333 of the crane rollers 329, 330 engage the upper and lower rails 811, 812 of the channel section 809. The engagement between the crane rollers 329, 330 and the channel section 809 is configured to properly laterally align the portable pump and fuel containment system 200 to the mount 800. Additionally, the portable pump and fuel containment system 200 may be rolled along the base plate 801 while the crane rollers 329, 330 roll along the channel section 809 until the front lip segment 323 of the lower support 301 contacts (e.g., abuts) the front wall 802 of the mount 800, and then a fastener (e.g., a pin or a lock) may be inserted through the opening 818 in the front wall 802 of the mount 800 and the aligned opening 334 in the front lip segment 323 of the lower support 301 of the portable pump and fuel containment system 200. Additionally, a lock (e.g., a padlock and/or a conventional tow hitch lock) may be inserted through the first pair of aligned openings 814, 815 and/or the second pair of aligned openings 816, 817 in the channel section 809 to prevent rotation of the portable pump and fuel containment system 200 relative to the mount 800. In this manner, the portable pump and fuel containment system 200 may be secured for transportation by a vehicle.

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention. Although relative terms such as "inner," "outer," "upper," "lower," and similar terms have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" or "coupled to" another component, it can be directly on or attached to the other component or intervening components may be present therebetween.

What is claimed is:

1. A portable pump and fuel containment system comprising:

a portable base assembly comprising:

a lower support having an upper surface and a lower surface; and a plurality of wheels coupled to the lower surface of the lower support;

a container on the upper surface of the lower support, the container defining an interior volume, an inlet port in fluid communication with the interior volume, and an outlet port in fluid communication with the interior volume; and a liquid transfer assembly coupled to the portable base assembly, the liquid transfer assembly comprising:

a pump comprising an inlet, an outlet, and a motor;

a three-way control valve comprising a first inlet, an outlet, a second inlet, a valve, and a lever coupled to the valve, wherein the lever is movable between a first position in which the valve places the first inlet in fluid communication with the outlet, and a second position in which the valve places the second inlet in fluid communication with the outlet;

a flexible transfer line comprising a first transfer line segment and a second transfer line segment, the first transfer line segment being coupled to the first inlet of the three-way control valve and the second transfer line segment extending from the outlet port of the container to the second inlet of the three-way control valve; and a flexible return line having a first end coupled to the outlet of the pump and a second end detachably coupled to the inlet port of the container, wherein the outlet of the three-way control valve is connected to the inlet of the pump, wherein, when the pump is activated and the lever is in the first position, the pump pumps fluid through the first transfer line segment and the flexible return line and into the interior volume of the container through the inlet port, and wherein, when the pump is activated, the lever is in the second position, and the second end of the flexible return line is detached from the inlet port, the pump pumps the fluid in the interior volume of the container out through the second transfer line segment and the flexible return line.

2. The portable pump and fuel containment system of claim 1, further comprising a y-valve coupled between the outlet of the three-way control valve and the inlet of the pump, the y-valve comprising a y-strainer.

3. The portable pump and fuel containment system of claim 1, further comprising a stinger coupled to an end of the first transfer line segment, the stinger comprising at least one filter.

4. The portable pump and fuel containment system of claim 3, wherein the stinger further comprises:

a body having a first end, a second end opposite the first end, and a passage extending from the first end to the second end, the second end of the body being detachably couplable to the first transfer line segment; and a filter cap coupled to the first end of the body, the filter cap comprising a one-way valve, wherein the at least one filter comprises a primary filter, a secondary filter, and a tertiary filter of the filter cap.

5. The portable pump and fuel containment system of claim 4, wherein the primary filter has a first mesh size, the secondary filter has a second mesh size less than the first mesh size, and the tertiary filter has a third mesh size less than the second mesh size.

6. The portable pump and fuel containment system of claim 1, further comprising a drop pipe coupled to an end of the second transfer line segment, the drop pipe extending downward through the interior volume and including a lower end proximate to a bottom of the container.

7. The portable pump and fuel containment system of claim 6, wherein the lower end of the drop pipe is spaced apart from the bottom of the container by a distance in a range from approximately 1 inch to approximately ¼ inch.

8. The portable pump and fuel containment system of claim 1, further comprising a ball float valve in the interior volume of the container and coupled to the second end of the flexible return line.

9. The portable pump and fuel containment system of claim 8, further comprising a check valve coupled to the second end of the flexible return line, the check valve being between the ball float valve and the second end of the flexible return line and permitting the fluid to flow from the flexible return line and into the interior volume of the container and preventing the fluid from flowing out of the interior volume of the container and into the flexible return line.

10. The portable pump and fuel containment system of claim 1, wherein the pump is a diaphragm pump.

11. The portable pump and fuel containment system of claim 1, further comprises a grounding strap coupled to the lower support.

12. The portable pump and fuel containment system of claim 1, wherein the container further comprises a vertical vent pipe.

13. The portable pump and fuel containment system of claim 1, further comprising a cam lock detachably connecting the second end of the flexible return line to the inlet port of the container.

14. The portable pump and fuel containment system of claim 1, further comprising a battery assembly on the lower support of the portable base assembly.

15. The portable pump and fuel containment system of claim 14, wherein the battery assembly comprises:

an explosion proof box;

at least one rechargeable battery housed in the explosion proof box;

a first corrosion resistant fitting coupled to a charging port of the at least one rechargeable battery;

a second corrosion resistant fitting coupled to a power port of the at least one rechargeable battery; and an electrical cable connecting the motor of the pump to the second corrosion resistant fitting, the electrical cable forming a waterproof seal with the second corrosion resistant fitting.

16. The portable pump and fuel containment system of claim 15, wherein the portable base assembly further comprises:

an upper support; and a partition connecting the upper support to the lower support, wherein the upper support, the lower support, and the partition together define an isolation zone, and wherein the battery assembly is in the isolation zone and the container is outside of the isolation zone.

17. A system comprising:

the portable pump and fuel containment system of claim 1; and a mount configured to facilitate transportation of the portable pump and fuel containment system.

18. The system of claim 17, wherein the lower support of the portable base assembly comprises a pair of crane rollers.

19. The system of claim 18, wherein the mount comprises:

a base plate;

a front wall extending upward from the base plate;

a sidewall extending upward from the base plate; and a channel section coupled to an interior surface of the sidewall, the channel section comprising an upper rail and a lower rail below the upper rail, wherein the pair of crane rollers engage the channel section when the portable pump and fuel containment system is supported on the mount.

20. The system of claim 19, wherein: the front wall of the mount comprises a first opening, the lower support of the portable base assembly comprises a base plate, a front lip segment extending along a front edge of the base plate, and a second opening in the front lip segment, and the second opening is alignable with the first opening to receive a fastener or a lock for securing the portable pump and fuel containment system to the mount.

* * * * *